US008858727B2

(12) United States Patent
Jerg et al.

(10) Patent No.: US 8,858,727 B2
(45) Date of Patent: Oct. 14, 2014

(54) DISHWASHER MACHINE COMPRISING A SORPTION DRYING DEVICE

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 779 days.

(21) Appl. No.: 13/054,085

(22) PCT Filed: Jul. 27, 2009

(86) PCT No.: PCT/EP2009/059674
§ 371 (c)(1),
(2), (4) Date: Jan. 14, 2011

(87) PCT Pub. No.: WO2010/012689
PCT Pub. Date: Feb. 4, 2010

(65) Prior Publication Data

US 2011/0114137 A1 May 19, 2011

(30) Foreign Application Priority Data

Jul. 28, 2008 (DE) ..... 10 2008 040 789
Aug. 27, 2008 (DE) ..... 10 2008 039 893

(51) Int. Cl.
*B08B 3/00* (2006.01)
*A47L 15/42* (2006.01)
*A47L 15/48* (2006.01)

(52) U.S. Cl.
CPC ..... *A47L 15/481* (2013.01); *A47L 15/4287* (2013.01)
USPC ..... 134/56 D; 134/57 D

(58) Field of Classification Search
None
See application file for complete search history.

(56) References Cited

U.S. PATENT DOCUMENTS

| | | | |
|---|---|---|---|
| 3,378,933 | A | 4/1968 | Jenkins |
| 3,862,786 | A | 1/1975 | Brezosky |
| 5,966,959 | A | 10/1999 | Stewart |
| 7,585,373 | B2 | 9/2009 | Jerg et al. |
| 2006/0278257 | A1 | 12/2006 | Jerg et al. |
| 2007/0245899 | A1 | 10/2007 | Merdzo |
| 2007/0295360 | A1 | 12/2007 | Jerg et al. |
| 2007/0295370 | A1 | 12/2007 | Jerg et al. |
| 2007/0295373 | A1 | 12/2007 | Jerg et al. |
| 2008/0011329 | A1 | 1/2008 | Classen et al. |

(Continued)

FOREIGN PATENT DOCUMENTS

| | | | |
|---|---|---|---|
| CN | 200951070 | Y | 9/2007 |
| DE | 816989 | C | 10/1951 |

(Continued)

OTHER PUBLICATIONS

National Search Report CN 200980129489.

(Continued)

*Primary Examiner* — Jason Ko
(74) *Attorney, Agent, or Firm* — James E. Howard; Andre Pallapies

(57) ABSTRACT

A dishwasher having a washing compartment; an air ducting channel to generate an airflow; and a sorption drying system to dry wash items. The sorption drying system has a sorption compartment with reversibly dehydratable sorption material that is connected to the washing compartment via the air ducting channel. The air ducting channel is coupled to the sorption compartment such that the airflow enters the sorption compartment with an inflow direction and changes direction to a through-flow direction in which the airflow flows through the inside of the sorption compartment.

32 Claims, 12 Drawing Sheets

(56) References Cited

U.S. PATENT DOCUMENTS

| | | | |
|---|---|---|---|
| 2008/0295875 | A1 | 12/2008 | Jerg et al. |
| 2010/0101613 | A1 | 4/2010 | Jerg et al. |
| 2011/0114136 | A1 | 5/2011 | Jerg et al. |
| 2011/0139196 | A1 | 6/2011 | Jerg et al. |

FOREIGN PATENT DOCUMENTS

| | | | |
|---|---|---|---|
| DE | 8026939 | U1 | 2/1982 |
| DE | 3614345 | CI | 9/1987 |
| DE | 3830664 | A1 | 3/1990 |
| DE | 29618572 | U1 | 4/1998 |
| DE | 4441264 | A1 | 11/1998 |
| DE | 19718047 | A1 | 11/1998 |
| DE | 10353774 | A1 | 2/2005 |
| DE | 10353775 | A1 | 2/2005 |
| DE | 60010201 | T2 | 5/2005 |
| DE | WO2005053504 | A1 | 6/2005 |
| DE | 202008011159 | U1 | 12/2008 |
| EP | 0358279 | A1 | 3/1990 |
| FR | 2924592 | A1 | 6/2009 |
| RU | 55407 | U1 | 8/2006 |
| WO | WO2007118882 | A3 | 10/2007 |

OTHER PUBLICATIONS

Report of Examination CN 200980129489.

Non-Final Office Action issued in corresponding U.S. Appl. No. 13/059,235 on Sep. 12, 2013.

Non-Final Office Action issued in corresponding U.S. Appl. No. 13/054,084 on Sep. 26, 2013.

DISHWASHER MACHINE COMPRISING A SORPTION DRYING DEVICE

BACKGROUND OF THE INVENTION

The present invention relates to a dishwasher machine, in particular a household dishwasher machine, having at least one washing compartment and at least one sorption drying system for drying washed items, it being possible for the sorption drying system to comprise at least one sorption compartment with a reversibly dehydratable sorption material, and said compartment to be connected to the washing compartment by means of at least one air ducting channel for generating an air flow.

Dishwasher machines having a so-called sorption column for drying dishes are known, for example, from DE 103 53 774 A1, DE 103 53 775 A1 or DE 10 2005 004 096 A1. In this case, for drying dishes, in the "drying" sub-program step of the respective dishwashing program of the dishwasher machine, moist air from the washing compartment of the dishwasher machine is passed by means of a blower through the sorption column and due to its reversible dehydratable desiccant moisture is extracted by condensation from the air passing through. For the regeneration, that is to say desorption of the sorption column, its reversible dehydratable desiccant is heated up to very high temperatures. Water stored in this material therefore emerges as hot water vapor and is conveyed into the washing compartment by means of the airflow generated by the blower. Washing liquor and/or dishes located in the washing compartment, as well as the air present in the washing compartment, are heated up in this way. Such a type of sorption column has proved to be very advantageous for energy saving and gentle drying of the dishes. To avoid local overheating of the desiccant during the desorption process in DE 10 2005 004 096 A1, for example, a heater is arranged in the direction of the airflow prior to the air inlet of the sorption column. In spite of this "air heating", during desorption it remains difficult in practice to always completely dry the reversible dehydratable desiccant in a satisfactory manner.

BRIEF SUMMARY OF THE INVENTION

The object underlying the invention is to provide a dishwasher machine, in particular a household dishwasher machine, having a much improved sorption and/or desorption result for the reversibly dehydratable desiccant of the sorption unit of a sorption drying device.

This object is achieved in a dishwasher machine, in particular a household dishwasher machine, of the type described in the introduction, in that the air ducting channel is coupled to the sorption compartment in such a way that the airflow enters the sorption compartment in an inflow direction and changes into a through-flow direction which differs from the inflow direction and in which the flow flows through the inside of the sorption compartment.

This ensures to a large extent that washed items in the washing compartment can be perfectly dried in an energy-efficient and reliable manner. The drying facility can also be compactly installed in the dishwasher machine.

In particular, it is more or less ensured that, during the respective, required drying cycle, moist air that is conveyed via the air ducting channel from the washing compartment into the sorption compartment, and flows through said compartment's sorption unit with the sorption desiccant, can be perfectly dried by sorption in an energy-efficient and reliable manner by means of the sorption desiccant. Later on, following this drying cycle, for example during at least one washing or cleaning cycle of a subsequent, restarted dishwashing program, the sorption material can be regenerated, that is to say conditioned again by desorption to fully prepare for a subsequent drying cycle in a perfect, energy-efficient way which spares material.

Other developments of the invention are described in the sub-claims.

BRIEF DESCRIPTION OF THE DRAWINGS

The invention and its developments are explained in detail below with the aid of drawings in which.

DETAILED DESCRIPTION OF EXEMPLARY EMBODIMENTS OF THE PRESENT INVENTION

Those elements in FIGS. 1 to 17 having identical function and mode of operation are provided with the same reference numbers.

Figure 1:
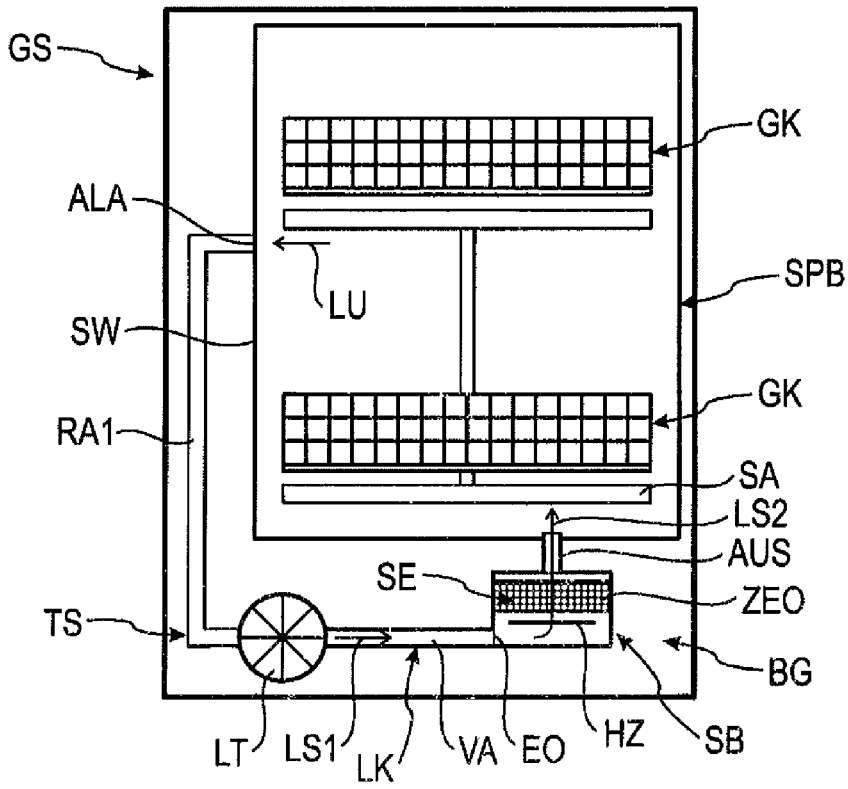
FIG. 1 shows schematically a dishwasher machine with a washing compartment and a sorption drying system whose components are constructed according to the inventive design principle.

FIG. 1 shows a schematic representation of a dishwasher machine GS, which as main components contains a washing compartment SPB, a base assembly BG arranged thereunder, and a sorption drying system TS in accordance with the inventive design principle. The sorption drying system TS is preferably provided externally, that is to say outside of the washing compartment SPB, partially on one side wall SW and partially in the base assembly BG. As main elements it includes at least one air ducting channel LK, at least one fan unit or a blower LT inserted in said air ducting channel, as well as at least one sorption compartment SB. Preferably, one or more mesh baskets GK for holding and washing items to be washed, for example dishes, are accommodated in the washing compartment SB. In order to spray the washing items to be cleaned with a liquid, one or more spray devices such as one or more rotating spray arms SA, for example, are provided inside the washing compartment SPB. In the exemplary embodiment shown here, both a lower spray arm and an upper spray arm are suspended in a rotatable manner in the washing compartment SPB.

In order to clean wash items, dishwasher machines run wash programs which have a plurality of program steps. The respective wash program can in particular include the following individual program steps which run chronologically: a pre-wash step for the removal of coarse soiling, a cleaning step with the addition of detergent to liquid, in particular water, an intermediate washing step, a rinsing step with the application of liquid or water containing rinse aids or surfactants, as well as a final drying step by which the cleaned washing items are dried. At the same time, depending on the cleaning step or rinse cycle of a selected dishwashing program, fresh water and/or process water containing cleaner is applied to the respective wash items to be washed, for example for a cleaning cycle, for an intermediate rinsing cycle and/or a rinsing cycle.

Here in the exemplary embodiment, the fan unit LT and the sorption compartment SB are accommodated in the base assembly BG underneath the base of the washing compartment SPB. The air ducting channel LK runs from an outlet opening ALA which is provided above the base BO of and in the side wall SW of the washing compartment SBP, out of this side wall SW then downwards with an inlet-side tubular section RA1 to the fan unit LT in the base assembly BG. The output of the fan unit LT is connected to an inlet opening EO of the sorption compartment SB in a region thereof close to the base, via a connecting section VA of the air ducting channel LK. The outlet opening ALA of the washing compartment SPB is preferably provided above the base BO thereof in the middle or central region of the side wall SW in order to suck air from the inside of the washing compartment SPB. As an alternate to this, it is obviously also possible to place the outlet opening ALA in the rear wall RW of the washing compartment SPB (see FIG. 2). In general terms, it is especially advantageous to provide the outlet opening preferably at least above a foam level up to which foam can form during a washing cycle, preferably in the upper half of the washing compartment SPB and in one of its side walls SW and/or rear wall. If required, it can also be useful to insert a plurality of outlet openings in at least one side wall, top wall and/or the rear wall of the washing compartment SPB, and to connect these to at least one air ducting channel having one or more inlet openings in the housing of the sorption compartment SB before the beginning or start of its sorption material line.

The fan unit LT is preferably designed as an axial fan. It provides forced ventilation of a sorption unit SE in the sorption compartment SB with moist hot air LU from the washing compartment SPB. The sorption unit SE contains reversibly dehydratable sorption material ZEO, which can receive and store moisture from the air LU ducted through it. At the upper side in the region close to the top of its housing the sorption compartment SB has an outflow opening AO (see FIGS. 4, 5), which is connected to the inside of the washing compartment SPB via an outlet element AUS through a push-through opening DG (see FIG. 13) in the base BO of the washing compartment SPB. In this way, during a drying step of a dishwashing program, for drying cleaned washed items, moist hot air LU can be sucked from the inside of the washing compartment SPB through the outlet opening ALA by means of the actuated fan unit LT into the inlet end tubular section RA1 of the air ducting channel LK and conveyed via the connecting section VA into the inside of the sorption compartment SB for forced ventilation of the reversibly dehydratable sorption material ZEO in the sorption unit SE. The sorption material ZEO of the sorption unit SE extracts water from the moist air flowing through it, so that air dried by the sorption unit SE can be blown into the inside of the washing compartment SPB via the outlet element or exhaust element AUS. A closed air circulation system is provided in this way by this sorption drying system TS. The spatial arrangement of the different components of this sorption drying system TS is evident from the schematic, perspective representation of FIG. 2 and the schematic side view of FIG. 3. In FIG. 3 the shape of the base BO is additionally drawn with a dash-dot line to better illustrate the spatial-geometrical relationship of the construction of the sorption drying system TS.

The outlet opening ALA is preferably arranged at a point above the base BO, which facilitates the collection or suction of the greatest amount of moist hot air LU from the upper halves of the washing compartment SPB into the air ducting channel LK. Following a cleaning cycle, in particular a rinsing cycle with heated liquid, moist hot air preferably accumulates above the base BO, in particular in the upper halves of the washing compartment SPB. The outlet opening ALA is preferably at a height above the level of foam which can occur with regular washing operations or in the event of a malfunction. In particular, foam can be caused by detergent in the water during the washing cycle. On the other hand, the position of the exit point or outlet opening ALA is chosen in such a way that a rising length is freely available at the side wall SW for the inlet-side tubular section RA1 of the air ducting channel LK. Moreover, due to the exit opening or outlet opening in the central region, top region and/or upper region of the side wall SW and/or rear wall RW of the washing compartment SPB, water from the sump in the base of the washing compartment or from its liquid spraying system is largely prevented from spraying directly through the outlet opening ALA of the washing compartment SPB into the air ducting channel LK and then getting into the sorption compartment SB, which otherwise could make its sorption material ZEO unduly damp, partly damage it or render it unusable, or even completely destroy it.

In the direction of flow, upstream of the sorption unit SE of the sorption compartment SB, at least one heating device HZ is arranged for desorption and thus regeneration of the sorption material ZEO. The heating device HZ serves to heat up air LU that is driven by means of the fan unit LT through the air ducting channel LK into the sorption compartment. This forced, heated air takes up the stored moisture, in particular water, from the sorption material ZEO while flowing through the sorption material ZEO. This water which is driven out of the sorption material ZEO is conveyed by the heated air via the outlet element AUS of the sorption compartment SB into the inside of the washing compartment. This desorption process preferably takes place when the heating-up of liquid for a cleaning cycle or other washing cycle of a subsequent dishwashing program is desired or carried out. In the course of this, the air heated up by the heating device HZ for the desorption process can at the same time be utilized just for heating up the liquid in the washing compartment SPB or to assist a conventional water heater, which saves energy.

Figure 2:
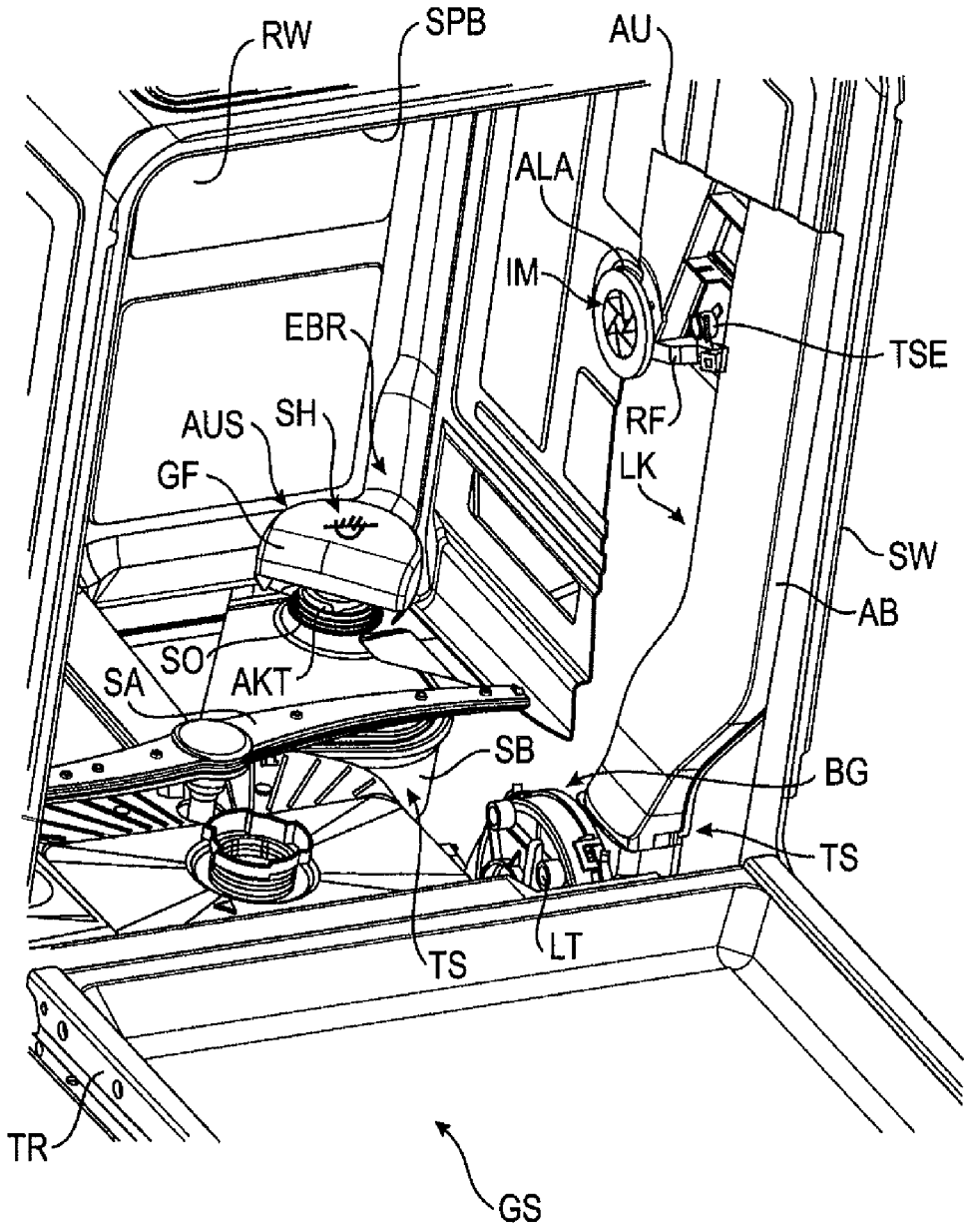
FIG. 2 shows a schematic, perspective view of the opened washing compartment of the dishwasher machine of FIG. 1, with components of the sorption drying system, which are drawn partially exposed, that is to say without a cover.
Figure 3:
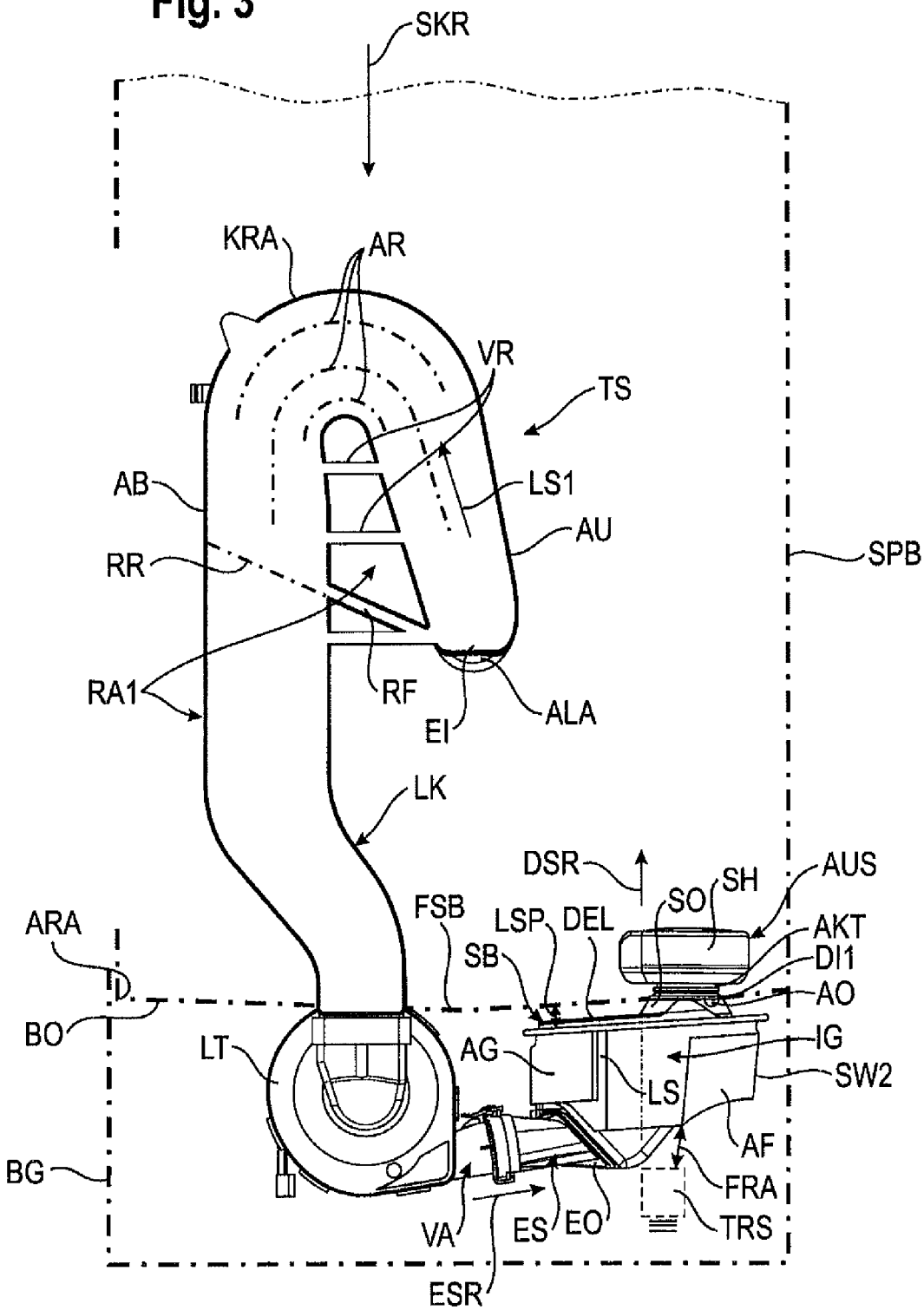
FIG. 3 shows a schematic side view of the entire unit of the sorption drying system of FIGS. 1, 2, whose components are accommodated partially on the outside of one side wall of the washing compartment and partially in a base assembly underneath the washing compartment.

With the door TR of the dishwasher machine GS of FIG. 1 open, FIG. 2 shows a partly exposed, perspective representation of main components of the sorption drying system TS in the side wall SW and the base assembly BG. Matching this, FIG. 3 shows the totality of the components of the sorption drying system TS viewed from the side. Starting from the high point of its inlet opening E1 at the location of the outlet opening ALA of the washing compartment SPB, the inlet-side tubular section RA1 of the air ducting channel LK has, with respect to the direction of gravity, an ascending tubular section AU and then, with respect to the direction of gravity SKR, a descending tubular section AB. The ascending tubular section AU runs upwards at a slight incline with respect to the vertical direction of gravity SKR and changes to a curved section KRA that is a convex bend and for the inflowing airflow LS1 forces a direction reversal of around 180° downwards into the essentially vertically descending tubular section AB connected to it. The latter ends in the fan unit LT. The first ascending tubular section AU, the curved section KRA and the subsequent, second descending tubular section AB form a flat channel with an essentially flat, rectangular, cross-sectional geometrical shape.

One or more ribbed flow guides or discharge ribs AR which follow this curved shape are provided inside the curved section KRA. In the exemplary embodiment a plurality of curved discharge ribs AR are essentially concentrically nested within one another and arranged with a lateral spacing between each other inside the curved section KRA. Here in the exemplary embodiment they also extend over part of their length into the ascending tubular section AU and into the descending tubular section AB. These discharge ribs AR are arranged at heights above the outlet ALA of the washing compartment SPB or the inlet E1 of the inlet-side tubular section RA1 of the air ducting channel LK. These discharge ribs AR are used to pick up drops of liquid and/or condensate from the airflow LS1 sucked in from the washing compartment SPB. In the sectional region of the ascending tubular section AU, the drops of liquid accumulated on the flow guiding ribs AR can drain away in the direction of the outlet ALA. In the region of the descending tubular section AB the drops of liquid can drain away from the flow guiding ribs AR towards a return rib RR. Furthermore the return rib RR is provided at a position inside the descending tubular section AB, which is higher than the outlet opening ALA of the washing compartment SPB or which is higher than the inlet opening E1 of the air ducting channel LK. Here the return rib RR inside the descending tubular section AB forms a discharge gradient and is axially aligned with a lateral connecting pipe RF in the direction of the outlet ALA of the washing compartment SPB. At the same time the lateral connecting pipe RF bridges the space between the limb of the ascending tubular section AU and the limb of the descending tubular section AB. Here the lateral connecting pipe RF interconnects the inside of the ascending tubular section AU and the inside of the descending tubular section AB. The gradient of the return rib RR and the axially-aligned lateral connecting pipe RF connected to it is chosen so as to ensure that a return of condensate of condensed water or other drops of liquid drain away from the discharge ribs AR downwards in the region of the descending tubular section AB into the outlet opening ALA of the washing compartment SPB.

The discharge ribs AR are preferably installed on the inner wall of the air ducting channel LK facing away from the side wall SW of the washing compartment, since the outside of this inner wall of the air ducting channel is cooler than the inner wall of the air ducting channel LK facing the washing compartment SPB. Condensed water condenses to a greater extent on this cooler inner wall than on the inner wall of the air ducting channel LK which faces the side wall SW. It can also suffice if the discharge ribs AR are constructed as web elements, which project from the outer inner wall of the air ducting channel LK only over part of the width of the total cross-sectional width of the air ducting channel, which is constructed as a flat channel, in the direction of the inside inner wall of the air ducting channel facing the side wall SW, so that a lateral gap in the cross-section remains for the through-flow of air. However, if required, it can also be useful to make the discharge ribs AR continuous between the outside inner wall and the inside inner wall of the air ducting channel LK. This will achieve specific air ducting, in particular in the curved section KRA. Disturbing air turbulence is largely avoided. A desired air volume can be conveyed in this way through the air ducting channel constructed as a flat channel.

The return rib RR is preferably installed inside as a web element on the outside inner wall of the air ducting channel LK, said web element projecting over a part of the entire width of the flat air ducting channel LK in the direction of its inside inner wall. This ensures that a sufficient through-passage cross-section remains open for the airflow LS1 to flow through in the region of the return rib RR. Alternately, it can of course also be useful to provide the return rib RR as a continuous element between the outside inner wall and the inside inner wall of the air ducting channel LK and to provide, in particular, centrally-positioned through-openings for the passage of air.

The discharge ribs AR and the return ribs RR also serve, in particular, to remove water droplets, detergent droplets, rinse aid droplets and/or other aerosols which are present in the inflowing air LS1, and to convey them back through the outlet opening LA into the washing compartment SPB. This is especially advantageous during a desorption cycle if a cleaning step is taking place at the same time. During this cleaning cycle a relatively large volume of steam or mist can be present in the washing compartment SPB, due in particular to the spraying of liquid by means of the spray arm SA. Such steam or mist can contain finely distributed water, detergent or rinse aid, as well as other cleaning agents. The discharge ribs AR form a collecting system for these finely dispersed liquid particles carried along in the airflow LS1. Alternately, instead of discharge ribs AR, other separation means, in particular objects with a large number of corners such as wire screens for example, can advantageously also be provided.

In particular, the upwards inclined or essentially vertical, ascending tubular section AU ensures that liquid droplets or even spray jets which are sprayed out from a spraying device SA, such as a spray arm during the cleaning process, or other spraying process, for example, are largely prevented from reaching the sorption material of the sorption compartment directly via the sucked-in airflow LS1. Without this retention or this separation of liquid droplets, in particular mist droplets or steam droplets, the sorption material ZEO for a sorption cycle could be rendered unduly damp and unusable during the drying step. In particular, it could lead to premature saturation by injected liquid droplets such as mist droplets or steam droplets, for example. Furthermore, due to the inlet-side, ascending branch AU of the feed-through channel as well as the one or more separating elements or collecting elements in the upper knee or apex of the curved section KRA between the ascending branch AU and the descending branch AB of the feed-through channel, this largely prevents detergent droplets, rinse aid droplets and/or other aerosol droplets reaching beyond this barrier and downwards to the fan LT and from there into the sorption compartment SB. It is obviously also possible to provide a barrier device of different construction but with the same function, instead of the combination of ascending tubular section AU and descending tubular section AB, and instead of one or more separating elements.

In summary, here in the exemplary embodiment the dishwasher machine GS has a drying device for drying washed items by sorption by means of reversibly dehydratable sorption material ZEO which is stored in a sorption compartment SE. The latter is connected to the washing compartment SPB via at least one air ducting channel LK for the generation of an airflow LS1. Along its inlet-side tubular section RA1 the air ducting channel has an essentially flat rectangular cross-sectional geometrical shape. Viewed in the direction of flow, after its inlet-side tubular section RA1, the air ducting channel changes into an essentially cylindrical tubular section VA. It is preferably manufactured from at least one plastics material. It is arranged in particular between one side wall SW and/or rear wall RW of the washing compartment and one outer housing wall of the dishwasher machine. Here the air ducting channel LK has at least one ascending tubular section AU. It extends upwards from the outlet opening ALA of the washing compartment SPB. Furthermore, viewed in the direction of flow, after the ascending tubular section AU it has at least one descending tubular section AB. At least one curved section KRA is provided between the ascending tubular section AU and the descending tubular section AB. The curved section KRA has, in particular, a larger cross-sectional area than the ascending tubular section AU and/or the descending tubular section AB. One or more flow guiding ribs AR for homogenizing the airflow LS1 are provided inside the curved section KRA. If necessary, at least one of the flow guiding ribs AR extends beyond the curved section KRA into the ascending tubular section AU and/or descending tubular section AB. The one or more flow guiding ribs AR are provided in positions above the height of the outlet ALA of the washing compartment SPB. The respective flow guiding rib AR extends from the channel wall facing the washing compartment housing to the opposite channel wall of the air ducting channel LK facing away from the washing compartment housing, preferably essentially continuously. At least one return rib RR is provided inside the descending tubular section AB on the channel wall facing the washing compartment housing and/or channel wall of the air ducting channel LK facing away from the washing compartment housing, at a point which is higher than the inlet opening E1 of the air ducting channel LK. For condensate recirculation, the return rib RR is connected to the inlet opening E1 of the air ducting channel LK via a lateral connecting pipe RF in the space between the descending tubular section AU and the descending tubular section AB. Said return rib slopes towards the inlet opening E1. The return rib extends from the channel wall facing the washing compartment housing to the opposite channel wall of the air ducting channel LK facing away from the washing compartment housing, preferably only over a part of the cross-sectional width.

In FIG. 3 the descending branch AB of the air ducting channel LK is inserted essentially perpendicularly into the fan unit LT. The sucked-in airflow LS1 is blown by the fan unit LT on the outlet side into the base region of the sorption compartment SB via a tubular connecting section VA into an inlet connector ES of said sorption compartment coupled thereto. In the course of this the airflow LS1 flows into the lower region of the sorption compartment SB in an inflow direction ESR and changes into a different flow direction DSR with which it flows through the inside of the sorption compartment SB. This through-flow direction DSR runs from the bottom upwards through the sorption compartment SB. In particular, the inlet connector ES guides the incoming airflow LS1 into the sorption compartment DB in such a way that this incoming airflow is deflected from its inflow direction ESR, in particular, by approximately 90 degrees into the through-flow direction DSR of the sorption compartment SB.

As FIG. 3 shows, the sorption compartment SB is arranged underneath the base BO in a base assembly BG of the washing compartment SPB, and more or less freely suspended in such a way that, for thermal protection, it has a specific minimum gap clearance LS (also see FIG. 10) in relation to adjacent components and/or parts of the base assembly BG. With a predetermined clearance FRA, at least one transportation safety element TRS is provided for the sorption compartment SB which is freely suspended from the cover element of the base assembly BG underneath the base BO of the washing compartment, in such a way that the sorption compartment SB is supported from underneath if the sorption compartment SB is displaced downwards from its freely-suspended position during transportation. The sorption compartment SB has, at least in the region of its sorption unit SE, at least one external housing AG in addition to its internal housing IG so that at this point its entire housing is constructed with a double wall. Between the internal housing IG and the external housing AG there therefore exists an air gap LS acting as a thermally-insulating layer. Because the sorption compartment SB is constructed, at least partially or entirely, with a double wall around the region of its sorption unit SE, in order to adequately protect any adjacent elements and components of the base assembly BG from undue overheating or burning, this provides a further overheating protection measure in addition to or independently of the freely-suspended support or installation of the sorption compartment SB.

To generalize, the housing of the sorption compartment SB has a geometrical shape such that an adequate clearance exists as thermal protection around the remaining parts and components of the base assembly BG. For this purpose, for example, the sorption compartment SB has at its housing wall SW2 facing the rear wall RW of the base assembly BG, a curved shape AF which corresponds to the geometrical shape of the rear wall RW facing it.

Figure 13:
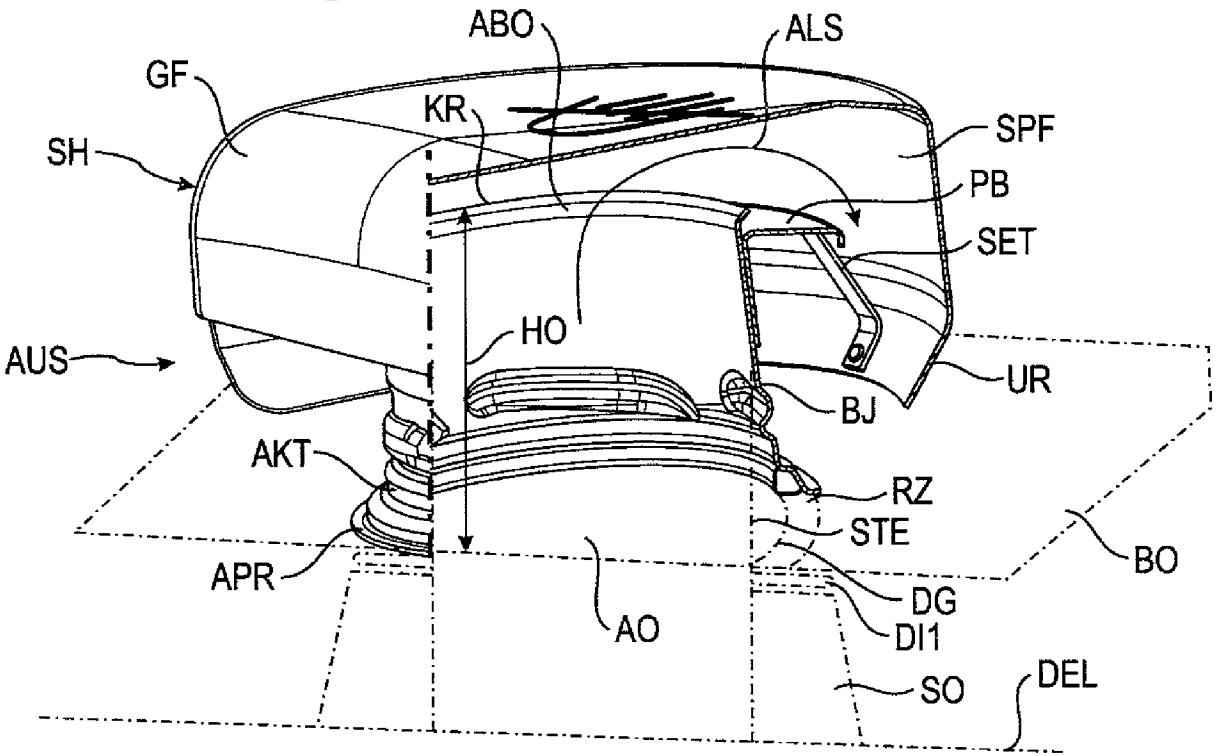

The sorption compartment SB is mounted on the underside of the base BO, in particular in the region of a through-hole DG (see FIG. 3, 13) of the base BO of the washing compartment SPB. This is illustrated in particular in the schematic side view of FIG. 3. At that point the base BO of the washing compartment SPB has a gradient running from its outer edges ARA towards a liquid collecting area FSB. The sorption compartment SB is mounted on the base BO of the washing compartment SPB in such a way that its cover part DEL runs essentially parallel to the underside of the base BO and with a predetermined gap clearance LSP with said base. For the freely-suspended support of the sorption compartment SB, a coupling connection is provided between at least one component on the underside of the base, in particular a socket SO of the sorption compartment DB and a component on the top side of the base, in particular the outlet element AUS of the sorption compartment SB in the region of a through-opening DG in the base BO of the washing compartment SPB. In particular, a locking connection is provided as a coupling connection. The locking connection can be formed by a releasable connection, in particular a screw connection, with or without bayonet lock BJ (see FIG. 13) between the component of the sorption compartment SB underneath the base and the component of the sorption compartment SB on top of the base. A peripheral zone RZ (see FIG. 13) around the one through-opening DG of the base BO is clamped between an outlet component on the underside of the base, such as SO of the sorption compartment SB for example, and the outlet element or spray protection component AUS arranged above the base BO. In FIG. 13, for the sake of simplicity the base BO and the lower part on the underside of the base are denoted by dash-dotted lines. The outlet component on the underside of the base and/or the spray protection component AUS on the upperside of the base projects with its front end section through the through-opening DG of the base. The base-side outlet part has a socket SO around the outlet opening AO of the cover part DEL of the sorption compartment SB. The spray protection component AUS on the top side of the base has an outflow connection AKT and a spray protection hood SH. At least one sealing element DI1 is provided between the component AUS on the upperside of the base and the component SO on the underside of the base.

To summarize, the sorption compartment SB is therefore arranged more or less freely suspended underneath the base BO of the washing compartment SPB so that for thermal protection it has a predetermined minimum gap clearance LSP in relation to adjacent components and parts of the base assembly BG. A transportation safety element TRS is also permanently fixed to the base of the base assembly at a predetermined clearance FRA below the sorption compartment SB. This transportation safety element TRS is used if required to support the sorption compartment freely-suspended underneath the base BO of the washing compartment SPB if, for example, said sorption compartment swings downwards due to vibration when transported together with the base BO. This transportation safety element TRS can, in particular, be formed by an inverted U-shaped metal bracket that is permanently attached to the base of the base assembly. The sorption compartment SB has the outflow opening AO at the top of is cover part DEL. An upwards projecting socket SO is fitted around the outer rim of this outflow opening AO. A cylindrical socket connecting element STE (see FIGS. 4, 5, 9, 13) which projects upwards and acts as a mating part for the outflow connector or exhaust flue connector AKT to be attached to it, is mounted in the approximately circular opening of this socket SO. It preferably has an external thread with integral bayonet lock BJ that works in conjunction with the internal thread of the exhaust flue connector AKT. On its upper side the socket SO has the sealing ring DL1 running concentrically around the receiver edge of the socket connecting element STE. This is illustrated in FIGS. 3, 4, 9, 13. In this case the sorption compartment SB lies firmly pressed with this sealing ring DI1 to the underside of the base BO. It is maintained at a distance or clearance LSP from the underside of the base BO by the height of the socket SO. From the top side of the base BO the exhaust flue connector AKT is pushed downwards through the push-through opening DG of the base BO and screwed to the mating socket connector STE and secured against opening by the bayonet lock BJ. Here the exhaust flue connector AKT lies tightly against a circular outer peripheral zone RZ of the base BO around the through-opening DG with a circular outer edge APR. The outer peripheral zone RZ of the base BO around the through-opening DG is tightly clamped and sealed against fluids between a circular lower supporting edge APR of the exhaust flue connector AKT and the upper supporting edge of the socket AO by means of the sealing ring DI1 arranged at that point. Since the sealing ring DI1 presses onto the base BO from the underside, it is protected against ageing by any impairment or damage due to detergent in the washing liquid. A tight push-through connection between the exhaust flue AKT and the socket SO is formed in this way. Advantageously, at the same time this functions as a suspension device for the sorption compartment SB.

Because the socket SO projects upwards by the socket height LSP from the remaining surface of the cover part DEL, this ensures that a gap clearance exists between the cover part DEL and the underside of the base BO. Here in the exemplary embodiment of FIG. 3, the base BO of the washing compartment SPB runs from its continuous peripheral zone with the side walls SW and the rear wall RW, in an obliquely sloping manner towards a preferably central liquid collecting region FSB with a gradient. The pump sump PSU of a circulating pump UWP can be located under this (see FIG. 16). In FIG. 3 this is drawn with a dash-dotted line from the outside to the inside obliquely to the base BO running towards the lower-placed collecting region FSB. The arrangement of the pump sump PSU with the circulating pump UWP placed therein underneath the lower-placed collecting region FSB is clear from the plan view of the base assembly BG in FIG. 16. The sorption compartment SB is preferably mounted on the base BO of the washing compartment SPB so that its cover part DEL is essentially parallel to the underside of the base and runs up to this at a predetermined gap clearance LSP. For this purpose, at the socket connector STE which sits inside the socket SO, said socket is set inclined with an appropriate angle of inclination with respect to the surface normals of the cover part DEL.

According to FIGS. 4 to 10, the sorption compartment SB has a pot-shaped housing part GT that is closed with a cover part DEL. In the pot-shaped housing part GT at least the sorption unit SE is provided with reversibly dehydratable sorption material ZEO. The sorption unit SE is accommodated in the pot-shaped housing part GT in such a way that its sorption material ZEO can essentially be ventilated in or against the direction of gravity by an airflow LS2 which is produced by deflecting the airflow LS1 generated via the air ducting channel LK. The sorption unit SE has at least one lower screen or grating element US and at least one upper screen or grating element OS in a predetermined height clearance H from each other (see in particular FIG. 9). The spatial volume between the two screen or grating elements US, OS is more or less completely filled with the sorption material ZEO. At least one heating device HZ is provided in the pot-shaped housing part GT. In the pot-shaped housing part GT, viewed in the direction of the airflow DSR of the sorption compartment SB, the heating device HZ is provided, in particular, upstream of the sorption unit SE with the reversibly dehydratable sorption material ZEO. The heating device HZ is provided in a lower hollow space UH of the pot-shaped housing part GT in order to collect inflowing air LS1 from the air ducting channel LK. The inlet opening EO for the air ducting channel LK is provided in the pot-shaped housing part GT. The outlet opening AO for the outlet element AUS is provided in the cover part GT. A heat-resistant material, in particular sheet metal, preferably high-grade steel or a high-grade steel alloy, is used for the cover part DEL and the pot-shaped housing part GT. The cover part DEL closes the pot-shaped housing part GT more or less hermetically. The continuous outer edge of the cover part DEL is connected to the upper edge of the pot-shaped housing part GT merely by means of a mechanical connection, in particular by means of a formed, joined, snap-on, clip-on, in particular a bordered or clinched connection. The pot-shaped housing part GT has one or more side walls SW1, SW2 (see FIG. 5) which run essentially vertically. It has an external contoured shape which essentially corresponds to the internal contoured shape of an installation region EBR provided for it, in particular in a base assembly BG (see FIG. 16). The two side walls SW1, SW2 which border one another have external faces which run essentially at right-angles to each other. At least one side wall, for example SW2, has at least one shaped section such as AF, for example, which is essentially complementary to a shaped section on the rear wall and/or side wall of the base assembly BG, which is provided under the base BO of the washing compartment SPB. The sorption compartment SB is provided in a rear corner region EBR between the rear wall RW and an adjacent side wall SW of the dishwasher machine GS, in particular of its base assembly BG.

Figure 4:
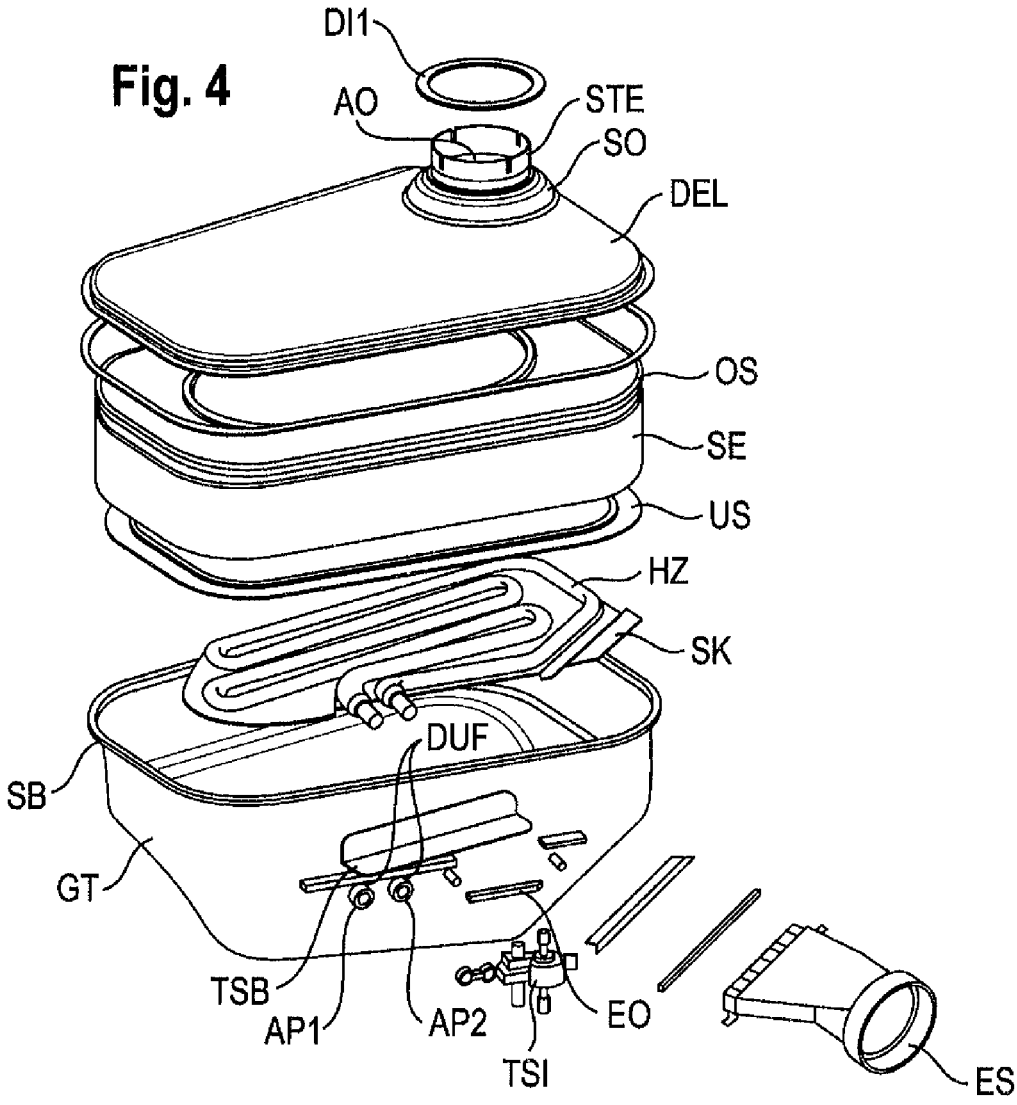
FIG. 4 shows a detail of a schematic, perspective, exploded view of various components of the sorption compartment of the sorption drying device of FIGS. 1 to 3.
Figure 5:
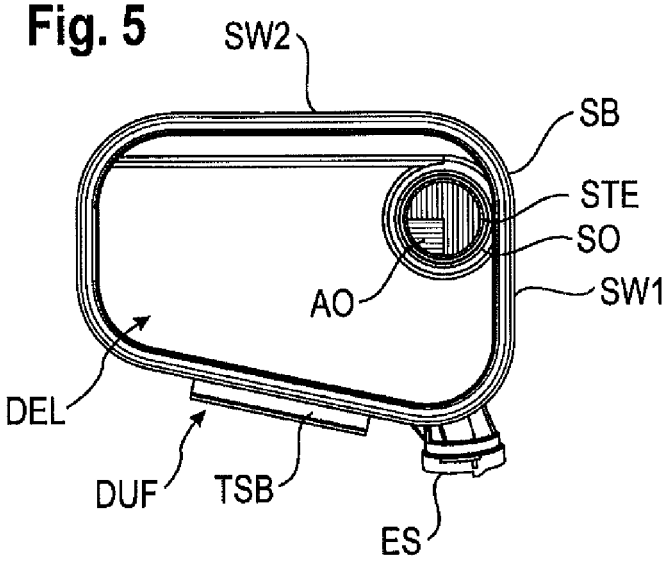
FIG. 5 shows a schematic, plan view of the sorption compartment of FIG. 4.
Figure 8:
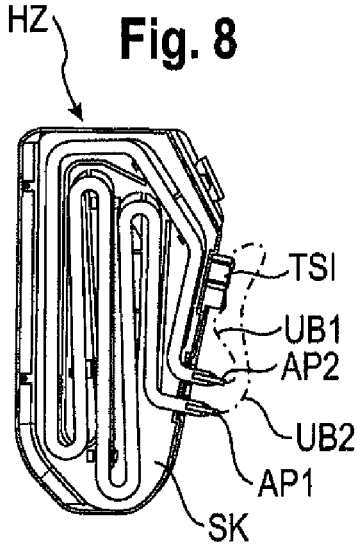
FIG. 8 shows a schematic, plan view from above of the coiled tube heater of FIG. 7, which is arranged above the slotted plate of FIG. 6.
Figure 9:
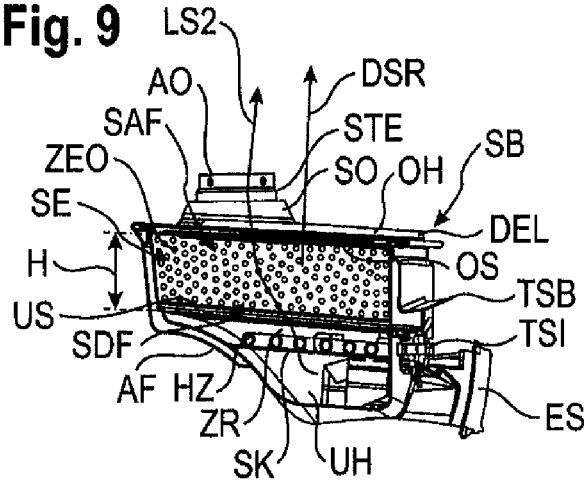
FIG. 9 shows a schematic, sectional, side view of the sorption compartment of FIGS. 4, 5.
Figure 6:
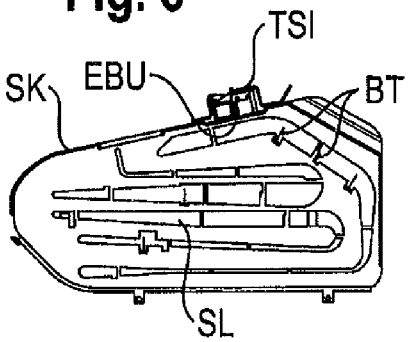
FIG. 6 shows a schematic, plan view from below, viewed as a component of the sorption compartment of FIG. 5, of a slotted plate for flow conditioning of air which flows through the sorption material in the sorption compartment.
Figure 7:
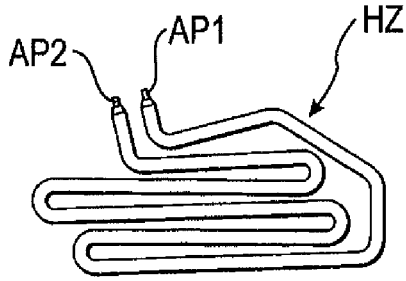
FIG. 7 shows a schematic plan view from below, viewed as a further detail of the sorption compartment of FIG. 4, of a coiled tube heater for heating and desorption of sorption material in the sorption compartment.

The pot-shaped housing part GT has at least one through-opening DUF for at least one electrical contact element AP1, AP2 (see FIG. 4). A drop protection plate TSB is mounted in a canopy region above the through-opening DUF at least over its extension. The drop protection plate TSB has a run-off incline.

FIG. 4 shows a schematic, perspective, exploded representation of the various components of the sorption compartment SB in the disassembled state. The components of the sorption compartment SB are arranged one above the other at several positional levels. This bottom-to-top layered construction of the sorption compartment SB is illustrated in particular in the sectional drawing of FIG. 9 and in the cut-open perspective illustration of FIG. 10. The sorption compartment SB has the lower hollow space UH near the base for collecting inflowing air from the inlet connector ES. A slotted plate SK which acts as flow conditioning means for a coiled tube heater HZ arranged above it, sits above this lower hollow space UH. Here the slotted plate SK sits on a continuous supporting edge running around the interior of the sorption compartment SB. With respect to the inner base of the sorption compartment SB, in order to form the lower hollow space UH this supporting edge has a predetermined height clearance. The slotted plate SK preferably has one or more clamping parts to enable it to be clamped laterally or at the side to a joint surface of at least one inner wall of the sorption compartment SB. This provides reliable and secure support for the slotted plate SK. According to the bottom view of the slotted plate of FIG. 6, this slot SL essentially follows the winding pattern of the coiled tube heater arranged above the slotted plate. At those locations at which the airflow LS1 enters the sorption compartment SB it has a lower velocity in the direction of through-flow DSR of the sorption compartment SB, and here the slots or openings SL of the slotted plate SK are made larger, in particular wider or broader than at those locations at which the airflow LS1 entering the sorption compartment has a higher velocity in the direction of the through-flow DSR of the sorption compartment SB. Homogenization of the local cross-sectional flow profile of the airflow LS2 which flows through the sorption compartment SB from bottom to top in the direction of through-flow DSR, is therefore largely achieved. In the context of the invention, the homogenization of the local cross-sectional flow profile of the airflow is understood to be, in particular, that essentially at each entry point of a through-flow area, essentially the same air volume flows through at approximately the same flow velocity.

Viewed in the direction of the through-flow DSR, the coiled tube heater RZ is arranged behind the slotted plate SK with a predetermined height clearance. For this, a height clearance above the opening SL can be maintained by means of a plurality of plates BT designed as webs. At the same time, these plates BT (see FIG. 6) support the coiled tube heater along its course, preferably alternating one below and one above. Therefore on the one hand this facilitates reliable and secure support for the coiled tube heater HZ above the slotted plate SK, and on the other hand warping of the slotted plate SK, which could occur due to the heat developed by the coiled tube heater HZ, is largely avoided. Viewed in the direction of through-flow DSR, the coiled tube heater HZ follows a clear space ZR (see FIG. 9), until the airflow LS2 essentially ascending from bottom to top enters the inlet cross-sectional area SDF of the sorption unit SE. This sorption unit SE has a lower screen or grating element US at the inlet side. An outlet-side, upper screen or grating element OS is provided at a height clearance H from this screen or grating element US. Sectional or all-round support edges are provided for the two screen elements US, OS at the inner walls of the sorption compartment, in order to position and retain the screen elements US, OS at their allotted heights. The two screen elements US, OS are preferably arranged in parallel with each other at this predetermined height clearance H. The sorption material ZEO is poured in between the lower screen element US and the upper screen element OS in such a way that the volume between the two screen elements US, OS is more or less completely filled. In the installed state of the sorption compartment SB the input-side screen element US as well as the output-side screen element OS, are arranged one above the other and separated from each other by the predetermined height clearance H with respect to the vertical center axis of the sorption compartment SB or with respect to its direction of through-flow DSR in essentially horizontal position planes. In other words, here in the exemplary embodiment the sorption unit SE is therefore formed with a filled volume of sorption material ZEO between a lower screen element US and an upper screen element OS. Viewed in the through-flow direction DSR, the upper hollow space OH for collecting outflowing air is provided above the sorption unit SE. This outflowing air LS2 is conveyed through the outlet AO of the socket connector STE into the exhaust flue connector ATK, from where it is blown into the interior of the washing compartment SPB.

Due to the slotted plate SK, conditioning or influencing of the flow of the flow LS2 ascending from bottom to top in the through-flow direction DSR is implemented in such a way that essentially the same volumetric airflow flows around the coiled tube heater at essentially each point of its longitudinal path. The combination of slotted plate and coiled tube heater HZ arranged above it largely ensures that the airflow LS2 upstream of the inlet area of the lower screen element US of the sorption unit SE can to a large extent be heated up evenly during the desorption cycle. At the same time the slotted plate ensures a largely consistent local distribution of the heated volumetric air flow viewed above the inlet cross-sectional area STF of the sorption unit SE.

Additionally to or independently of the slotted plate SK, if required it can also be useful to provide a heating device outside of the sorption compartment DE in the connecting section between the fan unit LT and the inlet opening of the sorption compartment SB. Since the average cross-sectional area of this tubular connecting section VA is less than the average cross-sectional area of the sorption compartment SB for an airflow, the airflow LS1 can to a large extent be evenly heated for the desorption cycle in advance before it reaches the sorption compartment SB. If necessary, the slotted plate SK can then be completely dispensed with.

In particular, if the heating-up of the air is done by means of a heating device in the sorption compartment SB, viewed in the through-flow direction DSR of the sorption compartment SB, if necessary it can also be useful, to provide both before and after the heating device HZ in each case at least one flow conditioning element in such a way that the volumetric airflow flowing through the volumetric quantity of sorption material ZEO after the inlet cross-sectional area SDF of the lower screen element US, is roughly the same at each point. Also, in particular, deactivating, that is to say switching off the heating device HZ during the sorption cycle, ensures to a great extent that all sorption material is more or less fully involved in the desiccation of the through-flowing air LS1. Similarly, during the desorption cycle in which the through-flowing air LS2 is heated up by the heating device HZ, water from all sorption material stored in the space between the two screen elements US, OS can again escape so that at all points within this spatial volume the sorption material ZEO is essentially completely dried and thus regenerated and can be made available for a subsequent drying cycle.

Here in the exemplary embodiment, the through-flow cross-sectional area SDF of the sorption unit SE inside the sorption compartment SB is designed to be greater than the average cross-sectional area of the inlet connector ES at the end of the air ducting channel LK or of the tubular connecting section VA. The through-flow cross-sectional area SDF of the sorption material is preferably designed to be between 2 and 40 times, in particular between 4 and 30 times, preferably between 5 and 25 times greater than the average cross-sectional area of the inlet connector ES of the air ducting channel LK with which this enters the inlet opening EO of the sorption compartment SB.

In summary, the sorption material ZEO fills a bulk volume between the lower screen element US and the upper screen element OS in such a way that the flow inlet cross-sectional area SDF also has a flow outlet cross-sectional area SAF essentially perpendicularly to the through-flow direction DSR which runs in the vertical direction. The lower screen element US, the upper screen element OS as well as the sorption material ZEO deposited between them each has mutual congruent penetration areas for the through-flowing air LS2. This ensures to a large extent that at each point in the volume of the sorption unit SE its sorption material can admit roughly the same volumetric flow. During desorption this largely prevents overheating points and thus possible damage to the sorption material ZEO. During sorption, this enables consistent uptake of moisture from the air to be dried and thus optimum utilization of the sorption material ZEO made available in the sorption unit SE.

Generalizing, it can therefore be useful to provide one or more flow conditioning elements SK in the sorption compartment SB and/or in an inlet-side tubular section VA, ES of the air ducting channel LK, in particular following at least one fan unit LT inserted in the air ducting channel LK, with one or more air openings SL, in such a way that regularization of the local flow cross-sectional profile of the airflow LS2 is achieved when air flows through the sorption compartment SB from bottom to top in its through-flow direction DSR. Viewed in the through-flow direction DSR of the sorption compartment SB, in the lower hollow space UH of the latter at least one flow conditioning element SK is provided with a height clearance in front of the heating device HZ. Here in the exemplary embodiment a slotted plate or perforated plate is provided as the flow conditioning element SK. The slots SL in the slotted plate SK essentially follow the winding path of a coiled tubular heater HZ, which is positioned as a heating device with a clearance above the slots SL in the slotted plate. The slotted plate is arranged essentially parallel and with a clearance to the air inlet cross-sectional area SDF of the sorption unit SE of the sorption compartment SE. Air openings, in particular slots SL in the flow conditioning element SK, are made at those locations at which the airflow LS1 entering the sorption compartment SB has a lower velocity in the through-flow direction DSR of the sorption compartment SB and higher than at those locations at which the airflow LS1 entering the sorption compartment SB has a higher velocity in the through-flow direction DSR of the sorption compartment SB.

In summary, the sorption drying system TS has the following specific flow conditions in the region of the sorption compartment SB. The air ducting channel LK is coupled to the sorption compartment SB in such a way that the incoming airflow LS1 enters the sorption compartment SB in an inflow direction ESR and changes to a different through-flow direction DSR, in which it flows through the inside of the sorption compartment SB. The outflow direction of the airflow LS2 leaving the sorption compartment SB essentially corresponds to the through-flow direction DSR. The inlet-side tubular section RA1 of the air ducting channel LK enters the sorption compartment SB in such a way that its inflow direction ESR is deflected into the through-flow direction DSR of the sorption compartment SB, in particular between 45° and 135°, preferably by approximately 90°. Viewed in the direction of flow, at least the fan unit LT is inserted upstream of the sorption compartment SB in the inlet-side tubular section RA1 of the air ducting channel LK for generating a forced airflow LS1 towards at least one inlet opening EO of the sorption compartment SB. The fan unit LT is arranged in the base assembly BG below the washing compartment SPB. The through-flow cross-sectional area SDF for the sorption material ZEP inside the sorption compartment SB is larger than the through-flow cross-sectional area of the inlet connector ES of the air ducting channel LK, with which this cross-sectional area enters the inlet opening EO of the sorption compartment SB. The through-flow cross-sectional area SDF of the sorption compartment SB is designed to be preferably between 2 and 40 times, in particular between 4 and 30 times, preferably between 5 and 25 times greater than the through-flow cross-sectional area of the inlet connector ES at the end of the air ducting channel LK, with which this cross-sectional area enters the inlet opening EO of the sorption compartment SB. At least one sorption unit SE with sorption material ZEO is accommodated in the sorption compartment in such a way that air LS1 which is conveyed into the sorption compartment SB from the washing compartment SPB via the air ducting channel LK, is able to flow through the sorption material ZEO essentially in or against the direction of gravity. The sorption unit SE of the sorption compartment SB has at least one lower screen or grating element US and at least one upper screen or grating element OS separated from each other by a predetermined height clearance H, it being possible for the spatial volume between the two screen or grating elements US, OS to be more or less completely filled with sorption material ZEO. The inlet cross-sectional area SDF and the outlet cross-sectional area SAF of the sorption unit SE of the sorption compartment SB are, in particular, essentially made to be of equal magnitude. Furthermore, the inlet cross-sectional area SDF and the outlet cross-sectional area SAF of the sorption unit SE of the sorption compartment SB are usefully, essentially arranged congruently with each other. Viewed in its through-flow direction DSR, the sorption compartment has at least one layer of a lower hollow space UH and one sorption unit SE arranged above it and downstream of it in the through-flow direction DSR. In its lower hollow space UH, said sorption unit has at least one heating device HZ. Above its sorption unit SE the sorption compartment SE has at least one upper hollow space OH for collecting outflowing air LS2. The sorption material ZEO fills the sorption unit SE of the sorption compartment SB with a bulk volume so as to form a flow inlet cross-sectional area SDF arranged essentially perpendicularly to the through-flow direction DSR and a flow outlet cross-sectional area SAF arranged more or less parallel to said flow inlet cross-sectional area. In its upper cover part DEL the sorption compartment SB has at least one outflow opening AO which is connected via a through opening DG in the base BO of the washing compartment SPB to the inside of the latter with the aid of at least one outflow component AKT.

The sorption material ZEO is advantageously stored in the sorption compartment SB in the form of the sorption unit SE in such a way that essentially an identical volumetric airflow value can flow through essentially each inlet point of the through-flow cross-sectional area SDF of the sorption unit SE. A reversibly dehydratable material containing aluminium and/or silicon oxide, and/or silica gel, and/or zeolite, in particular zeolite type A, X, Y alone or in any combination, is preferably provided as sorption material ZEO. The sorption material is usefully provided as filling in the sorption compartment SB in the form of a gritty solid or granular material having a large number of particle bodies with a grain size of essentially between 1 and 6 mm, in particular between 2.4 and 4.8 mm, it being possible for the layer height H of the particle bodies to correspond to at least 5 times their grain size. In the direction of gravity, the sorption material ZEO which exists as gritty solid material or granulate in the sorption compartment usefully has a layer height which essentially corresponds to 5 to 40 times, in particular 10 to 15 times the particle size of the gritty solid material or granulate. The layer height H of the sorption material ZEO is preferably chosen to be essentially between 1.5 and 25 cm, in particular between 2 and 8 cm, preferably between 4 and 6 cm. The gritty solid material or granulate can preferably be formed from a large number of essentially ball-shaped particle bodies. Advantageously, the sorption material ZEO formed as gritty solid material or granulate usefully has an average bulk density of at least 500 $kg/m^3$, in particular, essentially between 500 and 800 $kg/m^3$, in particular, between 600 and 700 $kg/m^3$, in particular, between 630 to 650 $kg/m^3$, in particular, preferably approximately 640 $kg/m^3$.

In the sorption compartment SB, the reversibly dehydratable sorption material ZEO for absorption of a quantity of moisture carried in the airflow LS2 is usefully provided with such a weight that the quantity of moisture absorbed by the sorption material ZEO is less than a quantity of liquid applied to the wash items, in particular a quantity of liquid applied in the rinsing step.

In particular, it can be useful if a weight of the reversibly dehydratable sorption material is supplied in the sorption compartment SB such that this weight is sufficient to absorb a quantity of moisture which essentially corresponds to an amount of wetting with which the wash items are wetted at the end of a rinsing step. The quantity of water absorbed preferably corresponds to between 4 and 25%, in particular between 5 and 15% of the quantity of liquid applied to the wash items.

Usefully, a weight essentially between 0.2 and 5 kg, in particular between 0.3 and 3 kg, preferably between 0.5 and 2.5 kg of sorption material ZEO is accommodated in the sorption compartment SB.

In particular, the sorption material ZEO has pores, preferably of a size of essentially between 1 and 12 Angstrom, in particular between 2 and 10, preferably between 3 and 8 Angstrom.

Usefully it has a water absorbing capacity of essentially between 15 and 40, preferably between 20 and 30 percentage by weight of its dry weight.

In particular, a sorption material is provided that is desorbable at a temperature essentially in the range between 80° and 450° C., in particular between 220° and 250° C.

The air ducting channel, the sorption compartment and/or one or more additional flow-influencing elements are usefully designed in such a way that an airflow having a volumetric flow essentially between 2 and 15 l/sec, in particular between 4 and 7 l/s can be achieved through the sorption material for this sorption and/or desorption.

In particular, it can be useful if at least one heating device HZ is assigned to the sorption material ZEO, with which an equivalent heating power of between 250 and 2500 W, in particular between 1000 and 1800 W, preferably between 1200 and 1500 W can be provided to heat the sorption material for its desorption.

Preferably, the ratio of the heating power of at least one heating device which is assigned to the sorption material for its desorption, to the volumetric airflow of the airflow which flows through the sorption material, is chosen to be between 100 and 1250 W sec/l, in particular between 100 and 450 W sec/l, preferably between 200 and 230 W sec/l.

Preferably, a through-flow cross-sectional area essentially between 80 and 800 $cm^2$, in particular between 150 and 500 $cm^2$, is provided in the sorption compartment for the sorption material.

Usefully, the layer height H of the sorption material ZEO over the inlet cross-sectional area SDF of the sorption compartment SB is essentially constant.

In particular, in the sorption compartment SB it is useful to design the sorption material for absorption of a quantity of water essentially between 150 and 400 ml, in particular between 200 and 300 ml.

Furthermore, at least one thermal overheating protection device TSI (see FIGS. 4, 6, 8, 9) is provided for at least one component of the sorption drying system TS. Such a component can preferably be formed by a component of the sorption compartment SB. At least one thermal overheating protection device TSI can be assigned to this component. This thermal overheating protection device TSI is mounted on the outside of the sorption compartment SB. At least one electrical thermal protection unit is provided as a thermal overheating protection device. Here in the exemplary embodiment it is assigned to the heating device HZ which is housed in the sorption compartment SB.

In the exemplary embodiment of FIGS. 4, 6, 8 and 9, the electrical thermal protection unit is provided in an external bay EBU on the inner housing IG of the sorption compartment SB in the height range of the heating device HZ. It contains at least one electrical thermal cut-out TSA and/or at least one fusible cut-out SSI (see FIG. 17). The electrical thermal cut-out TSA and/or the fusible cut-out SSI of the electrical thermal protection unit TSI are each inserted, preferably in series in at least one power supply line UB1, UB2 of the heating device HZ (see FIG. 8).

Furthermore, it can be useful to provide at least one control device HE, ZE (see FIG. 16) which in particular interrupts the power supply to the heating device HZ in the event of a malfunction. A malfunction is caused, for example, when an upper temperature limit is exceeded.

Moreover, the largely free-hanging suspension of the sorption compartment, in particular underneath the base BO of the washing compartment SPB can also act as a thermal overheating protection device.

Furthermore, the thermal overheating protection device can include a mounting of the sorption compartment SB in such a way that the sorption compartment SB has a predetermined minimum gap clearance LSP with respect to adjacent components and/or parts of a base assembly BG.

In addition to or independently of the above-mentioned measures, in the region of the sorption unit SE of the sorption compartment SB, at least one external housing AG in addition to the internal housing IG of the sorption compartment SB can be provided as a thermal overheating protection device. At the same time, an air gap clearance LS exists as a thermal insulation layer between the internal housing IG and the external housing AG.

Figure 17:
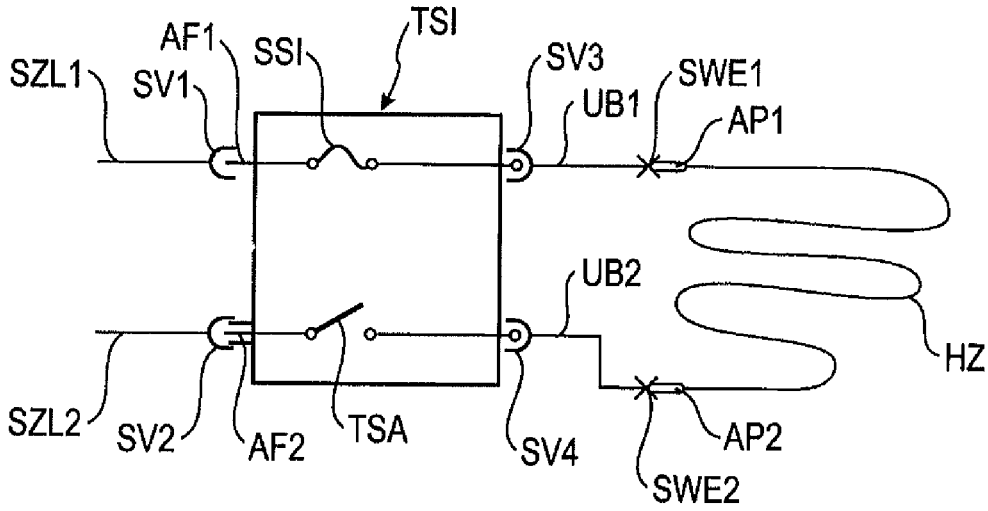
FIG. 17 shows a schematic representation of the thermoelectric thermal cut-out of the sorption compartment of FIGS. 4 to 10 of the sorption drying system of FIGS. 1 to 3, 11.

The coiled tube heater HZ of FIGS. 4, 7, 8, 9 has two connection terminals AP1, AP2 which are led out through corresponding through openings in the housing of the washing compartment SBP. Each connecting terminal or connecting pin AP1, AP2 is preferably connected in series with an overheating protection element. The overheating protection elements are combined in the thermal cut-out unit TSI which is arranged externally on the housing of the sorption compartment SB adjacent to the two terminal pins AP 1, AP2. FIG. 17 shows the overheating protection circuit for the coiled tube heater HZ of FIG. 8. The first bypass jumper UB1 is fitted to the first rigid terminal pin AP1 by means of a welded connection SWE1. The second bypass jumper UB2 is attached to the second rigid terminal pin AP2 in a corresponding fashion by means of a welded connection SWE2. The bypass jumper UB2 is electrically connected to the thermal cut-out TSA by means of a plug connector SV4. The bypass jumper UB1 is electrically connected to the thermoelectric fusible cut-out SSI via a plug contact SV3. At the input side, a first power supply lead SZL1 is connected to an outwardly guided terminal lug AF1 of the fusible cut-out element SSI via a plug connector SV1. A second power supply lead SZL2 is connected in corresponding fashion to an outwardly guided terminal lug AF2 of the thermal cut-out element TSA via a plug connector SV2. In particular, the second power supply lead SZL2 can form a neutral conductor, whilst the first power supply lead SZL1 can be a "live phase". The thermal cut-out TSA opens as soon as a first upper temperature limit of the coiled tube heater H2 is exceeded. As soon as this temperature again falls below the limit the thermal cut-out closes again so that the coiled tube heater HZ heats up again. However, if the coiled tube heater HZ reaches a critical upper temperature limit, which is above the first upper limit, then the fusible cut-out SSI melts and the circuit for the coiled tube heater HZ is permanently broken. The two thermal protection elements of the thermal protection device TSI are largely in close, thermally-conducting contact with the inner housing IG of the sorption compartment. They can be separately tripped if specific upper temperature limits specifically assigned to them are exceeded.

Figure 10:
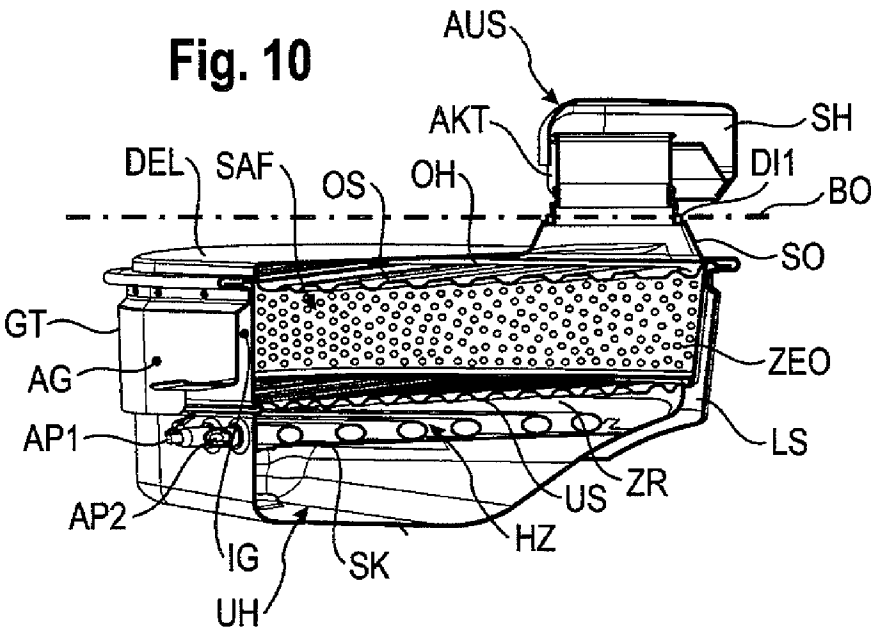
FIG. 10 shows a schematic, perspective, partially cut-away view of the internal construction of the sorption compartment of FIGS. 4, 5, 9.
Figure 11:
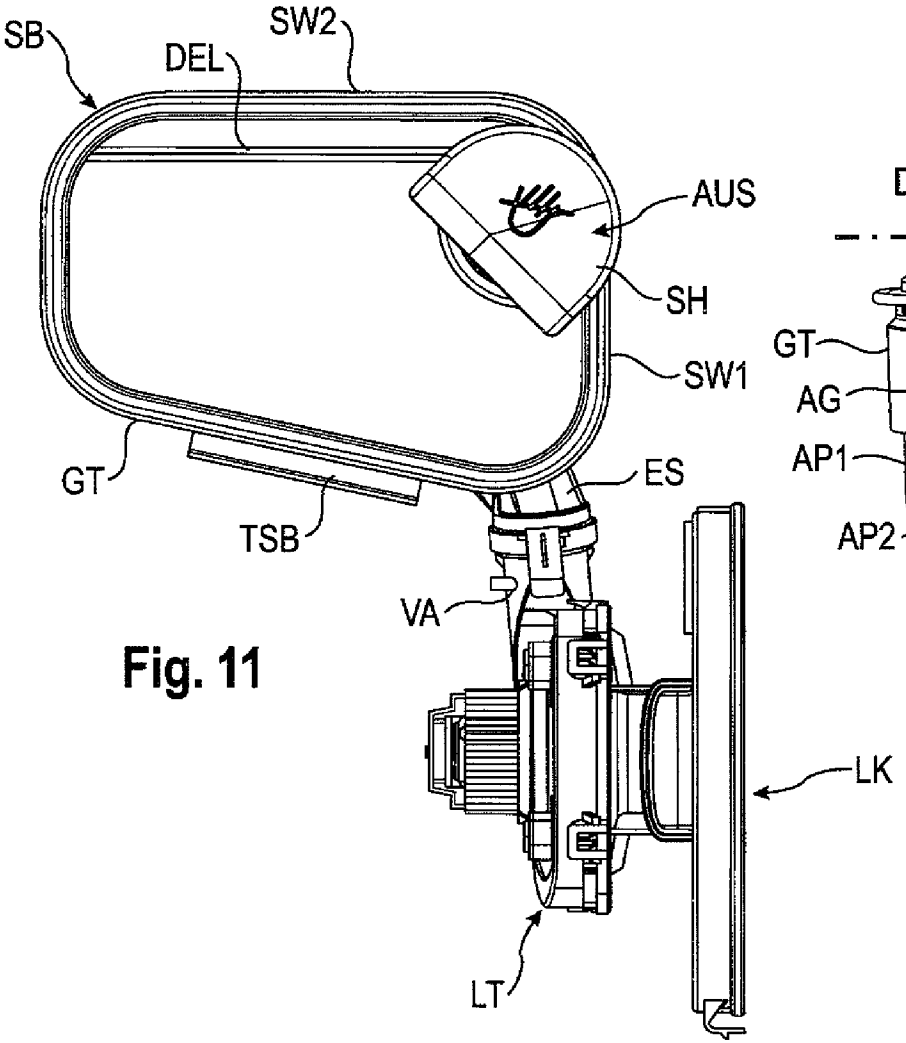
FIG. 11 shows a schematic plan view from above of the totality of components of the sorption drying system of FIGS. 1 to 10, FIGS. 12 to 14 show different schematic views of the outlet element of the sorption drying system of FIGS. 1 to 3, as a single unit.
Figure 14:
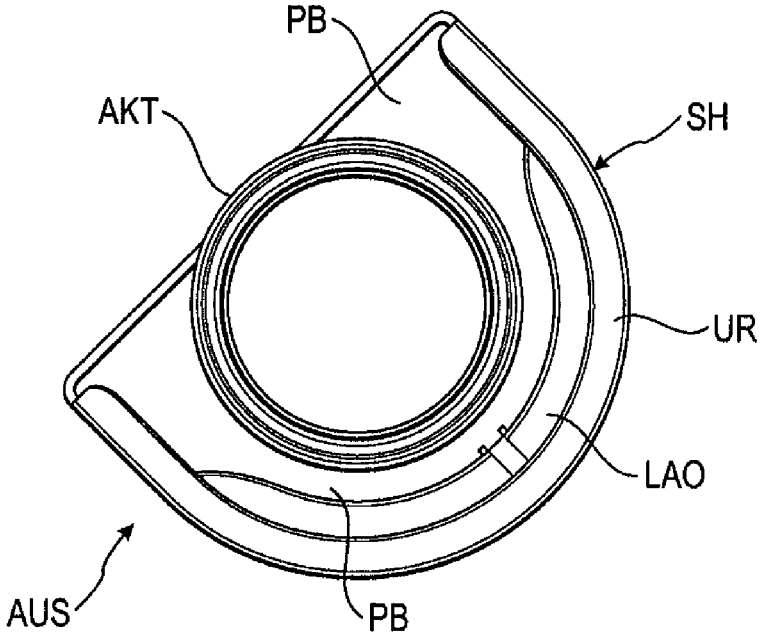

In accordance with FIGS. 10, 13, 14, the outflow connector AKT which is connected to the outlet opening AO in the socket SO of the sorption compartment SB, advantageously passes through the through opening GK of the base BO into a corner region EBR of the washing compartment SPB, which lies outside the rotational area traced by the spray arm SA. This is illustrated in FIG. 2. Generally speaking, the outflow connector AKT therefore projects out of the base BO at a point in the interior of the washing compartment SPB, which lies outside the rotational area traced by the lower spray arm SA. The exhaust flue connector or outflow connector AKT is covered along its upper end section by an overlapping or clinched spray protection hood SH.

Figure 12:
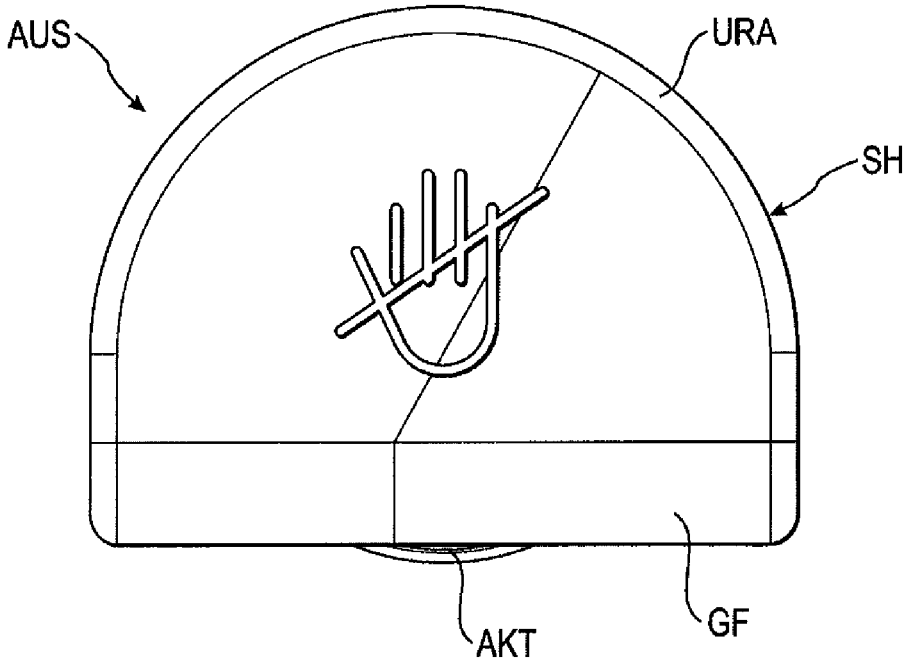

The spray protection hood SH covers the outflow connector AKT like an umbrella or mushroom. Viewed from above (see FIG. 12) this is completely closed at the top; in particular it is also fully closed at its underside in a region facing the spray arm SA. Here in the exemplary embodiment in a first approximation it has a semicircular cylindrical geometrical shape. In FIG. 12 the spray protection hood SH is shown schematically in a plan view. At its upper side it has convex domed, flattened-off areas GF (see FIG. 13) in the transition zones GF, URA between its largely plane-surface upper side and its essentially vertical downwards-projecting side walls (viewed from inside to outside). If a spray jet from the spray arm SA strikes these upper-edge, flattened-off or domed transition zones GF, URA, then this spray jet pours as a more or less flat film over the spray protection hood SH and cools this down during the desorption cycle.

To prevent liquid reaching the sorption compartment SB thru the outlet opening of the outflow connector AKT during spraying with the lower spray arm SA, one lower edge zone UR of the semicircular cylindrical cut-off side wall of the spray protection hood SH is bent or arched inwards towards the outflow connector AKT. This can be clearly seen in FIG. 13. In addition, a continuous, radially outwards-projecting spray water repelling element or shielding element PB, in particular a deflector plate, is provided in the region of the top edge of the outflow connector AKT. This extends radially outwards into the space or gap between the circular, cylindrical outflow connector AKT and the inner wall of the spray protection hood SH. At the same time, between the outer edge of this shielding element PB and the inner wall of the spray protection hood SH there remains a free through opening for an airflow which flows out of the outflow connector AKT towards the cover of the spray protection hood SH and in so doing is deflected downwards to the lower edge UR of the spray protection hood SH, in particular by approximately 180°. The deflected path is denoted by ALS in FIG. 13. In the exemplary embodiment of FIG. 13 the outwards-projecting shielding element PB is supported at individual points on the circumference of its outer edge by means of web elements SET opposite the inner wall of the side wall of the spray protection hood SH, forming a continuous circular segment section. Opposite the outlet connector AKT the spray protection hood SH is arranged at a free height clearance which forms a free space or hollow space.

FIG. 14 shows the spray protection hood SH viewed from below, together with the outflow connector AKT. Here the shielding element PB shields the outlet opening of the outflow connector AKT essentially all the way round as a laterally or sideways-projecting edge or web. In particular, the shielding element PB closes the underside of the spray protection hood SH in the region of the straight side wall facing the spray arm SA. A gap clearance LAO through which the air can flow out of the outflow connector AKT into the inside of the washing compartment SPB is left open only in the semicircular bent section of the spray protection hood SH between the shielding element PB and the outer, concentrically-arranged side wall of the spray protection hood SH radially offset from said shielding element. Here in the exemplary embodiment of FIG. 14 the gap clearance LAO is essentially sickle shaped. The airflow LS2 is therefore forced along a deflection path ALS which deflects it downwards from its vertical, upwards directed outflow direction, where it can exit only through the sickle shaped circular segment gap clearance LAO in the lower region of the spray protection hood SH. Usefully, the outflow connector AKT projects at such a height HO with respect to the base BO that its upper edge is higher than the level of a total quantity of a reference rinsing bath or foam provided for one washing cycle.

The outflow element AUS which is installed at the outlet side of the sorption compartment SB, and projects into the inside of the washing compartment SPB, is therefore usefully designed in such a way that the airflow LS2 leaving it is directed away from the spray arm SA. In particular, the outflowing airflow LS2 is deflected into a rear or back corner region between the rear wall RW and the adjoining side wall SW of the washing compartment. This largely prevents spray water or foam reaching the inside of the sorption compartment through the opening of the outflow connector during the cleaning cycle or other washing process. The desorption cycle could be impaired or totally ruined by this. In addition, sorption material could be permanently damaged by rinsing liquid. Extensive tests have shown that the functionality of the sorption material in the sorption compartment can be largely maintained or preserved over the lifespan of the dishwasher machine if water, detergent or rinse aid in the rinsing water are reliably prevented from reaching the sorption material.

To summarize, at least one outflow device AUS is connected to at least one outflow opening AO of the sorption compartment SB and so arranged inside the washing compartment SPB, that the air LS2 blown out from it is more or less directed away from at least one spray device SA housed in the washing compartment SPB. In this case the outflow device AUS is arranged outside the operating range of the spray device SA. The spray device can be a rotating spray arm SA, for example. The outflow device AUS is preferably provided in a rear corner region EBR between the rear wall RW and an adjoining side wall SW of the washing compartment SPB. The outflow device AUS has, in particular, an exhaust opening ABO with a height clearance HO above the base BO of the washing compartment SPB, which is higher than the level of a total quantity of a reference rinsing bath provided for one washing cycle. The outflow device AUS includes an outflow connector AKT and a spray protection hood SH. The spray protection hood SH has a geometrical shape which overlaps the exhaust opening ABO of the outflow connector AKT. The spray protection hood SH is extended over the exhaust connector AKT in such a way that air from the sorption compartment SB rapidly flows through the outflow connector AKT, with an ascending direction of flow, and a downwards-pointing forced flow path ALS can be imposed after exiting from the exhaust opening ABO of the outflow connector AKT. The outflow connector AKT projecting upwards above the base BO of the washing compartment SPB is coupled to the connecting element STE at the cover part DEL of the sorption compartment SB arranged under the base BO. The spray protection hood SH is closed at the top and the bottom in its housing region GF which faces the spray device SA. The spray protection hood SH covers the exhaust opening ABO of the outflow connector AKT, with an upper free space. At the same time, the outflow connector AKT has an upper, outwardly domed edge or all-round collar KR. The spray protection hood SH envelopes an upper end section of the exhaust connector AKT so that a gap clearance SPF is formed between its inner wall and the outer wall of the exhaust connector AKT. The gap clearance SPF between the spray protection hood SH and the outflow connector SKT is designed in such a way that an air outflow path ALS is provided out of the outflow connector AKT, which is directed away from the spray device SA in the washing compartment SB. A spray water shielding element PB projecting into the gap clearance SPF is provided at the exhaust connector AKT. One lower edge zone UR of the spray protection hood SH is bent inwards. The spray protection hood SH has an outer surface that is rounded off in such a way that it allows a spray jet of the spray device SA to pour away in the form of a film over its surface.

Figure 15:
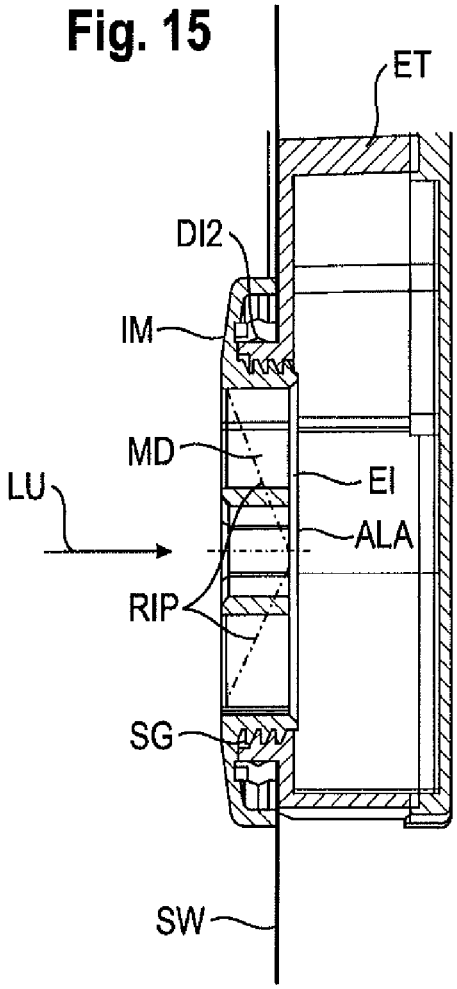
FIG. 15 shows a schematic, sectional, side view of the inlet element of the sorption drying system of FIGS. 1 to 3, as a single unit.

FIG. 15 shows a schematic longitudinal sectional representation of the fixing arrangement of the inlet-side, front end section ET of the air ducting channel LK in the region of the outlet opening ALA in the side wall SW of the washing compartment SPB of FIG. 2. The front end section ET of the air ducting channel LK projects into the inside of the washing compartment SPB in such a way that an all-round, vertically-projecting collar-type edge is formed opposite the side wall SW. Said collar-type edge has an internal thread SG. A circular inlet element IM with an external thread is screwed into this internal thread SG. It therefore functions as a fixing element for holding the end section ET. This circular fixing element has a torus-shaped, all-round seating chamber for a sealing element DI2. This sealing element DI2 seals an annular gap between the outer edge of the inlet-side front end section ET of the air ducting channel LK and the fixing element. Here in the exemplary embodiment the fixing element is formed, in particular, by a sleeve nut type of screwed ring that is screwed to the inlet-side, front end section ET of the air ducting channel LK. In the exemplary embodiment, the ring-type fixing element IM has a central passage MD through which air LU can be sucked out of the interior of the washing compartment SPB.

If necessary, it can also be useful to provide inside/or in front of the inlet opening MD of the inlet side tubular section ET of the air ducting channel LK at least one rib-shaped engagement protection arrangement which has continuous gaps between its engagement ribs RIP for the inflow of air from the washing compartment. In FIG. 15 these ribs RIP are denoted by dash-dot lines.

Figure 16:
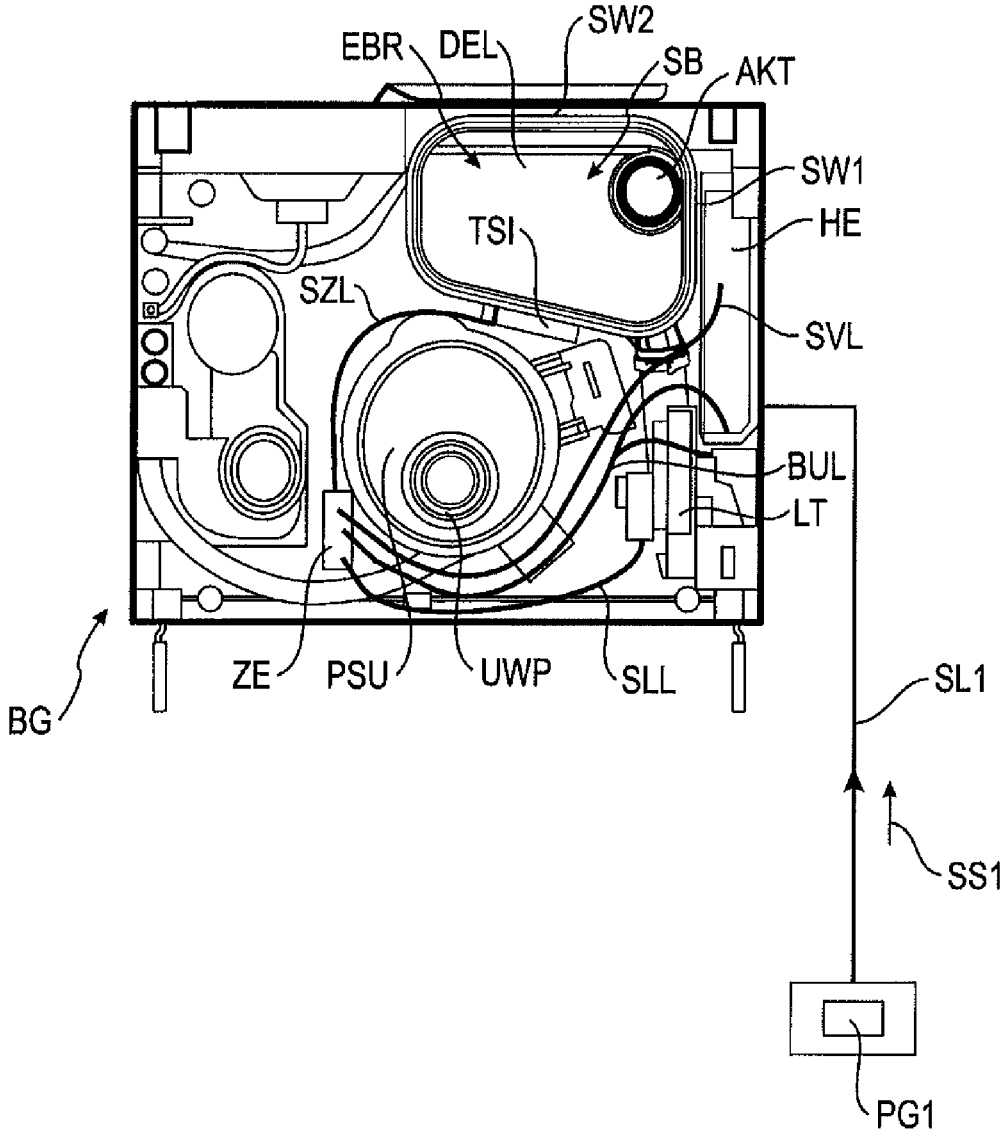
FIG. 16 shows a schematic, plan view from above of the base assembly of the dishwasher machine of FIG. 1 and FIG. 2.

FIG. 16 shows a schematic, plan view of the base assembly BG. In addition to the fan unit LT, the sorption compartment SB, circulating pump UWP, etc., it includes a main control device HE for its control and monitoring. The heating device HZ of the sorption compartment SB is regulated for its desorption cycle by means of at least one control device. Here in the exemplary embodiment it is formed by an auxiliary control device ZE. This is used to interrupt or connect the power supply lead SZL to the heating device HZ as required. The auxiliary control device ZE is controlled by the main control device HE via a bus cable BUL. A power supply lead SVL is led from the main control device HE to the auxiliary control device ZE. This also controls the fan unit LT via a control line SLL. In particular, the power supply lead of the fan unit LT can also be integrated into the control line SLL.

At least one temperature sensor TSE (see FIG. 2) which delivers corresponding measuring signals for the temperature in the interior of the washing compartment to the main control device, is also connected to the main control device HE via a signal line. Here the temperature sensor TSE is suspended between stiffening ribs VR (see FIG. 3) in the space between the two limbs of the inlet-side tubular section RA1 of the air ducting channel LK. At the same time it is placed in contact with the side wall SW of the washing compartment SPB.

As soon as a cleaning cycle is now started, at the same time the main control device HE switches on the auxiliary control device ZE via the bus cable BUL, so that an electrical voltage is applied to the terminal pins AP1, AP2 of the heating device HZ via the power connecting lead SZL. As soon as a specific, predetermined upper temperature limit is reached in the interior of the washing compartment SPB, which the main control device HE can determine via the measuring signals of the temperature sensor, said main control device can give the instruction to the auxiliary control device ZE via the bus cable, to remove the voltage on the power supply lead SZL and consequently completely disconnect the heating device HZ. As a result, the desorption cycle for the sorption material in the sorption compartment can be ended, for example.

If necessary, it can be useful to provide the option for an operator of the dishwasher machine to activate or deactivate the sorption drying system TS via the activation or deactivation of a specially provided program button or appropriate selection of a program menu. This is illustrated schematically in FIG. 16 which shows a program button or a program menu item PG1 which, via a control cable SL1 and control signals SS1, gives appropriate activation or deactivation signals to the control logic HE for switching the sorption drying system TE on or off.

In particular, a first selection button for selecting an "Energy" or "Sorption operation" program variant can be provided in the operator control panel of the dishwasher machine. In this program the emphasis is on energy saving. This is achieved in that during the rinsing cycle there is absolutely no heating by means of a continuous heater, and the drying of the washed items, in particular the dishes, is achieved solely with the aid of the sorption drying system TS.

In particular, in addition to pure sorption drying it can be useful to heat the interior of the washing compartment by means of heated rinsing liquid during the rinsing cycle. At the same time, it can be advantageous and sufficient if the heat transfer achieved by the rinsing cycle is carried out on the washed items to be dried with a lower use of energy than is the case without sorption drying. Electrical heating energy can be saved by sorption of air moisture by the sorption drying system now employed. Improved drying of wet or damp wash items can therefore be achieved by so-called "intrinsic heat drying" as well as by sorption drying, that is to say by a combination or supplementation of both types of drying.

In addition to or independently of the "Energy" button, a further "Drying power" button which increases the blower operating time of the fan unit can be provided in the operator control panel of the dishwasher machine. This can achieve improved drying of all kitchenware items.

In addition to or independently of the above special buttons, a further "Program run time" button can be provided. If the sorption drying system is switched on, the program run time can be reduced in contrast to conventional drying systems (without sorption drying). If necessary, the run time during cleaning can be further shortened by additional heating in the cleaning phase and optionally by increasing the spray pressure by increasing the motor speed of the circulating pump. Furthermore, the drying time can be further reduced by increasing the rinsing temperature.

In addition to or independently of the above specific buttons, an operating button with the "Influence the cleaning power" function can be provided. When this button is operated the cleaning power can be increased for the same constant run time, without increasing the energy consumption compared to a dishwasher machine without a sorption drying system. Heat energy for heating a desired total amount of rinsing bath liquid can be saved by starting the sorption cycle at the same time as the cleaning cycle and as a result hot air loaded with an amount of water coming from the sorption material, reaches the washing compartment.

The invention claimed is:

1. A dishwasher, comprising:

a washing compartment;

an air ducting channel to generate an airflow; and a sorption drying system to dry wash items, the sorption drying system having a sorption compartment with reversibly dehydratable sorption material that is connected to the washing compartment via the air ducting channel, a heating element upstream of the reversibly dehydratable sorption material, and a plate upstream of the heating element; wherein:

the air ducting channel is coupled to the sorption compartment such that the airflow enters the sorption compartment with an inflow direction and changes direction to a through-flow direction in which the airflow flows through the inside of the sorption compartment;

the through-flow direction is different from the inflow direction; and the plate includes a slot that the air flow is adapted to flow at least partially through and that corresponds to the heating element.

2. The dishwasher of claim 1, wherein the dishwasher is a household dishwasher.

3. The dishwasher of claim 1, wherein an outflow direction of the airflow coming from the sorption compartment essentially corresponds to the through-flow direction.

4. The dishwasher of claim 1, wherein the air ducting channel has an inlet-side tubular section that enters the sorption compartment such that the inflow direction of the air ducting channel is deflected into the through-flow direction of the sorption compartment.

5. The dishwasher of claim 2, wherein the inflow direction is deflected by a range of 45° to 135°.

6. The dishwasher of claim 5, wherein the inflow direction is deflected by approximately 90°.

7. The dishwasher of claim 1, wherein the washing compartment has a base, and wherein the sorption compartment is accommodated in a base assembly underneath the base of the washing compartment.

8. The dishwasher of claim 1, wherein, to a predetermined extent, the air ducting channel is arranged outside the washing compartment.

9. The dishwasher of claim 4, wherein, when viewed in flow direction, a fan is inserted upstream of the sorption compartment in the inlet-side tubular section of the air ducting channel to generate a forced airflow towards an inlet opening of the sorption compartment.

10. The dishwasher of claim 9, wherein the fan is arranged in a base assembly underneath the washing compartment.

11. The dishwasher of claim 1, wherein a through-flow cross-sectional area for the sorption material inside the sorption compartment is greater than a through-opening cross-sectional area of an inlet connector of the air ducting channel with which the air ducting channel enters an inlet opening of the sorption compartment.

12. The dishwasher of claim 11, wherein the through-flow cross-sectional area of the sorption compartment is between 2 and 40 times greater than the through-opening cross-sectional area of an end inlet connector of the air ducting channel with which the air ducting channel enters the inlet opening of the sorption compartment.

13. The dishwasher of claim 12, wherein the through-flow cross-sectional area of the sorption compartment is between 4 and 30 times greater than the through-opening cross-sectional area of the end inlet connector.

14. The dishwasher of claim 13, wherein the through-flow cross-sectional area of the sorption compartment is between 5 and 25 times greater than the through-opening cross-sectional area of the end inlet connector.

15. The dishwasher of claim 1, wherein a sorption unit with the sorption material is accommodated in the sorption compartment such that air which is conveyed from the washing compartment into the sorption compartment via the air ducting channel flows through the sorption material essentially in or against the direction of gravity.

16. The dishwasher of claim 1, wherein an inlet cross-sectional area and an outlet cross-sectional area of the sorption unit of the sorption compartment are essentially equal.

17. The dishwasher of claim 16, wherein the inlet cross-sectional area and the outlet cross-sectional area of the sorption unit of the sorption compartment are arranged essentially congruently with each other.

18. The dishwasher of claim 1, wherein, when viewed in a through-flow direction the sorption compartment, the sorption compartment has a layer of a lower hollow space and a sorption unit, wherein the sorption unit is arranged above the lower hollow space and, in the through-flow direction, downstream of the lower hollow space.

19. The dishwasher of claim 18, wherein the heating device in the lower hollow space.

20. The dishwasher of claim 18, wherein the sorption compartment has an upper hollow space above the sorption unit for collecting outflowing air.

21. The dishwasher of claim 18, wherein the sorption material in the sorption unit of the sorption compartment fills a bulk volume such that a flow inlet cross-sectional area is arranged essentially perpendicularly to the through-flow direction and a flow outlet cross-sectional area is arranged essentially parallel to the through-flow direction.

22. The dishwasher of claim 1, wherein the sorption compartment has an outflow opening in an upper cover part of the sorption compartment, the outflow opening connected via a through opening in a base of the washing compartment to the inside of the washing compartment by means of an outflow component.

23. The dishwasher of claim 22, wherein the outflow opening has a through-flow cross-sectional area that is smaller than an outlet cross-sectional area of a sorption unit of the sorption compartment.

24. The dishwasher of claim 23, wherein the through-flow cross-sectional area is between 2 and 40 times smaller than the outlet cross-sectional area.

25. The dishwasher of claim 24, wherein the through-flow cross-sectional area is between 4 and 30 times smaller than the outlet cross-sectional area.

26. The dishwasher of claim 25, wherein the through-flow cross-sectional area is between 5 and 25 times smaller than the outlet cross-sectional area.

27. The dishwasher of claim 1, wherein the through-flow direction is changed such that flow through the sorption material is uniform.

28. The dishwasher of claim 27, wherein the airflow flows through the reversibly dehydratable material such that essentially each point of a through-flow area has essentially the same air flow at approximately the same velocity.

29. The dishwasher of claim 28, wherein air flow through the reversibly dehydratable material is homogenized at a local cross-sectional flow profile in the through-flow direction.

30. The dishwasher of claim 1, wherein the sorption unit of the sorption compartment has a lower screen element or a first grating element and an upper screen element or a second grating element with a predetermined height clearance from each other, and a spatial volume between the lower and upper screen elements or the first and second grating elements is essentially completely filled with the sorption material.

31. The dishwasher of claim 1, wherein the slot follows a winding pattern of the heating element.

32. The dishwasher of claim 1, wherein the slot is wider at locations where the airflow enters the sorption compartment at a relatively low velocity and the slot is wider that at locations where the airflow enters the sorption compartment at a relatively high velocity.

* * * * *